US010851310B2

(12) United States Patent
Elligson et al.

(10) Patent No.: US 10,851,310 B2
(45) Date of Patent: Dec. 1, 2020

(54) DIRECT STEAM INJECTION (DSI) HEATING AND USE IN BITUMEN FROTH TREATMENT OPERATIONS

(71) Applicant: Fort Hills Energy L.P., Calgary (CA)

(72) Inventors: Shane Elligson, Calgary (CA); Siddharth Gupta, Calgary (CA); Juan Bavaresco, Calgary (CA); Shawn Van Der Merwe, Calgary (CA); Jaime Ward, Calgary (CA); Theunis Venter, Calgary (CA); David Buckingham, Calgary (CA)

(73) Assignee: Fort Hills Energy L.P., Calgary (CA)

( * ) Notice: Subject to any disclaimer, the term of this patent is extended or adjusted under 35 U.S.C. 154(b) by 0 days.

(21) Appl. No.: 16/563,238

(22) Filed: Sep. 6, 2019

(65) Prior Publication Data

US 2020/0080005 A1 Mar. 12, 2020

(30) Foreign Application Priority Data

Sep. 7, 2018 (CA) ..... 3016784

(51) Int. Cl.
*C10G 1/04* (2006.01)

(52) U.S. Cl.
CPC ..... *C10G 1/047* (2013.01); *C10G 2300/4006* (2013.01); *C10G 2300/807* (2013.01)

(58) Field of Classification Search
CPC ..... C10G 1/047; C10G 2300/807; C10G 2300/4006
See application file for complete search history.

(56) References Cited

U.S. PATENT DOCUMENTS

| | | | | |
|---|---|---|---|---|
| 6,955,340 | B2 | 10/2005 | Palm | |
| 7,025,338 | B2 | 4/2006 | Cincotta et al. | |
| 7,152,851 | B2 | 12/2006 | Cincotta | |
| 8,167,278 | B2 | 5/2012 | Cincotta | |
| 8,246,015 | B2 | 8/2012 | Schreib et al. | |
| 8,568,017 | B2 | 10/2013 | Zaiser et al. | |
| 9,207,017 | B2 | 12/2015 | Zaiser et al. | |
| 9,377,243 | B2 | 6/2016 | Cincotta | |
| 2009/0174087 | A1 | 7/2009 | Bauer | |
| 2009/0200688 | A1* | 8/2009 | Cincotta | F28C 3/08 261/76 |
| 2014/0011147 | A1* | 1/2014 | Van Der Merwe | F24H 9/00 432/29 |

* cited by examiner

*Primary Examiner* — Brian A McCaig
(74) *Attorney, Agent, or Firm* — BakerHostetler

(57) ABSTRACT

Direct steam injection (DSI) heating techniques can use a heater to heat a process stream in bitumen froth treatment. The DSI heater can include a diffuser with multiple side-by-side rows of outlets perpendicular to a longitudinal axis of the diffuser, and a piston plug that moves axially within the diffuser to selectively cover rows of outlets to vary steam injection. The piston plug has first and second annular seals and is moved between different axial positions in a stepwise fashion such that when one or more rows of outlets are completely covered, the first annular seal is located in between adjacent rows and the second annular seal abuts against the diffuser to inhibit passage of steam so as to prevent cavitation. The DSI heater can include various other features, such as particular seal unit constructions and diffuser outlet configurations.

38 Claims, 12 Drawing Sheets

DIRECT STEAM INJECTION (DSI) HEATING AND USE IN BITUMEN FROTH TREATMENT OPERATIONS

CROSS-REFERENCE TO RELATED APPLICATIONS

This application claims priority to Canadian patent application no. CA 3016784, filed on Sep. 7, 2018, the disclosure of which is hereby incorporated by reference in its entirety.

TECHNICAL FIELD

The technical field generally relates to direct steam injection (DSI) heating of process streams in bitumen froth treatment operations, and the like, and more particularly to enhance designs and operations for DSI heating of streams with variable heating requirements.

BACKGROUND

In bitumen froth treatment operations, various process streams require heating which can be achieved by directly injecting steam into the process stream. Direct steam injection (DSI) heaters can be used for this purpose where the DSI heaters include a diffuser that extends into the process stream and has outlets through which the steam is injected directly into the process stream.

Heating requirements of the process streams can vary over time and thus the DSI heaters can be configured to provide variable steam injection rates. Some DSI heaters use a dynamic approach where a component can be displaced in order to alternately expose or block some of the outlets of the diffuser so that more or less steam can be injected into the process stream. However, using these types of dynamic DSI heaters can lead to risks of steam leakage via joints and interfaces of the components that move with respect to each other, which can in turn lead to increased cavitation and wear on the equipment and/or inefficient heating operations.

There is indeed a need for technology that overcomes at least some of the drawbacks of existing DSI heating, particularly as used in bitumen froth treatment operations.

SUMMARY

Various techniques are described herein for providing enhanced direct steam injection (DSI) heating of process streams in a bitumen froth treatment operation. A (DSI) heater that has a diffuser and a piston plug operable for blocking or exposing steam injection outlets of the diffuser, can have certain features that provide enhanced operation for variable heating requirements.

For example, the diffuser can have outlets arranged in multiple side-by-side rows that are each perpendicular to a longitudinal axis of the diffuser, and the piston plug can have distal and proximal annular seals at respective ends to provide a seal in between the diffuser and the piston plug. The annular seals can be configured and positioned such that the distal annular seal is located in between and spaced apart from adjacent rows of outlets when the piston plug partially covers some of the rows, and the proximal annular seal inhibits steam from passing beyond it toward the covered outlets so as to prevent cavitation. The annular seals can also be positioned in conjunction with the controlled displacement of the piston plug such that the distal seal is always positioned in between two adjacent rows of outlets when covering some outlets to avoid steam impingement on the seal which could lead to premature wear.

The annular seals of the DSI heater can also have certain constructions for enhanced sealing and assembly of the seals around the piston plug. For example, the annular seals can have a composite construction with an inner spring-loaded annular core and an outer portion mounted about the core, which enables the core to push the outer portion to facilitate sealing contact against the inner wall of the diffuser and other surfaces where sealing is desired. Other annular seal units can have a construction where they include a ring and a connector that allows the ring to be pulled open and installed over top of the piston.

The diffuser can have outlets of a predetermined size to facilitate sonic steam flow. The diffuser can also have distal end rows of outlets that have fewer outlets per row to facilitate precision heating adjustments. The DSI heating can also be controlled according to various control strategies to provide accurate heating for variable heating requirements of process streams, such as bitumen froth and process water used in bitumen froth treatment operations.

In some implementations, there is provided a process for heating a process stream having variable heating requirements and flowing in a bitumen froth treatment operation, the process comprising:

- injecting steam directly into the process stream via a direct steam injection (DSI) heater comprising:
  - a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam at sonic flow conditions, the outlets being arranged in multiple side-by-side rows on respective planes that are each perpendicular to a longitudinal axis of the tubular body; and
  - a piston plug mounted within the tubular body of the diffuser and being configured to axially move between different positions within the tubular body, the piston plug comprising a plug body and at least a first annular seal and a second annular seal positioned adjacent opposed ends thereof;
- determining heating requirements of the process stream; and
- controlling the position of the piston plug within the tubular body of the diffuser in response to the determined heating requirements to provide an open area of the outlets through which steam is injected into the process stream, wherein the controlling comprises:
  - axially displacing the piston plug within the tubular body between different axial positions in a stepwise fashion to selectively cover or uncover a predetermined number of rows of outlets to provide the open area for steam injection, such that when one or more rows of outlets are completely covered:
    - the first annular seal is located in between and spaced apart from adjacent rows of outlets, and abuts against inner surfaces of the tubular body, and
    - the second annular seal abuts against inner surfaces of the tubular body to inhibit steam from passing beyond the second annular seal toward the covered outlets so as to reduce cavitation.

In some implementations, the piston plug is configured to progressively cover the rows of outlets upon distal displacement within the tubular body, and wherein the plug body is tubular allowing passage of steam therethrough. In some implementations, the plug body comprises a distal groove configured to receive the first annular seal therein. In some implementations, the plug body comprises a proximal groove configured to receive the second annular seal therein. In some implementations, the first and second annular seals are spaced apart from each other by a separation distance that is greater than a length of the perforated injection section. In some implementations, the proximal and distal grooves have substantially the same dimensions as each other. In some implementations, the first and second annular seals have substantially the same dimensions as each other. In some implementations, the first annular seal has a width of about 0.125 inch to about 0.25 inch. In some implementations, the rows of outlets are arranged such that adjacent rows are spaced apart from each other by about 0.59 inch to about 0.75 inch.

In some implementations, the rows of outlets are arranged such that adjacent rows are spaced apart from each other by a spacing distance between about twice to three times greater than a diameter of the outlets. In some implementations, the rows of outlets are arranged such that the rows are evenly spaced apart from each other. In some implementations, the rows of outlets comprise at least one distal end row at a distal end of the tubular body, and each distal end row has a smaller open area compared to the other rows. In some implementations, the distal end row has fewer outlets compared to the other rows. In some implementations, the distal end row has smaller outlets compared to the other rows. In some implementations, the outlets of the distal end row are each of the same size as the outlets in the other rows. In some implementations, the outlets of the rows proximal with respect to the distal end row are aligned longitudinally along an axis of the tubular body to form corresponding columns of outlets. In some implementations, the outlets of the distal end row are offset with respect to the columns of outlets along a circumference of the tubular body. In some implementations, the least one distal end row comprises two distal end rows of outlets.

In some implementations, wherein the piston plug further comprises a connection mechanism for connecting the plug body to a displacement stem, and the second seal is located on the plug body distally with respect to the connection mechanism. In some implementations, the connection mechanism comprises apertures extending transversely through the plug body; a pin extending through the apertures and through a distal opening in the displacement stem, the pin having opposed ends that extend beyond the plug body; and securing members which couple to the opposed ends of the pin to secure the pin with respect to the plug body.

In some implementations, at least some components of the DSI heater are composed of 4140HT steel that is surface hardened using gas nitriding. In some implementations, at least the tubular body of the diffuser is composed of 4140HT steel that is surface hardened using gas nitriding. In some implementations, the first and second annular seals are composed of a same material.

In some implementations, the determining of the heating requirements of the process stream comprises: measuring a temperature of the process stream downstream of the DSI heater; comparing the measured temperature with a target temperature; and determining a corresponding increase or decrease in steam injection via the DSI heater to achieve the target temperature.

In some implementations, the controlling of the piston plug within the tubular body of the diffuser comprises: closing a number of rows of outlets in response to a determined decrease in steam injection to achieve the target temperature by displacing the piston plug in a single step to the corresponding position; and opening a number of rows of outlets in response to a determined increase in steam injection to achieve the target temperature by displacing the piston plug in a single step to the corresponding position.

In some implementations, multiple DSI heaters are provided in series for heating the process stream; and the multiple DSI heaters are controlled to provide an overall steam injection. In some implementations, multiple DSI heaters are provided in parallel. In some implementations, the multiple DSI heaters are provided in at least two parallel heating trains, each train comprising at least two of the DSI heaters. In some implementations, the parallel heating trains are operated alternately.

In some implementations, the process stream comprises a slurry stream, a bitumen froth stream, a hydrocarbon stream, a process water stream or a tailings stream. In some implementations, the bitumen froth treatment operation is a paraffinic froth treatment operation.

In some implementations, the sonic flow conditions of the steam are provided by substantially maintaining a constant steam velocity and providing the outlets with size and configuration for sonic flow.

In some implementations, the steam provided from the steam source to the diffuser has a steam temperature that is at least 10° C. superheated. In some implementations, the steam provided from the steam source to the diffuser has a steam temperature that between 10° C. and 25° C. superheated. In some implementations, the steam provided from the steam source to the diffuser has a steam pressure of at least 2000 kPag. In some implementations, the steam provided from the steam source to the diffuser has a steam pressure of at least 2200 kPag. In some implementations, the steam provided from the steam source to the diffuser has a steam pressure of between 2100 and 2950 kPag.

In some implementations, the first and second annular seals each comprise: an annular core; and an outer portion mounted about the annular core. In some implementations, the annular core is composed of metal. In some implementations, the annular core is spring loaded. In some implementations, the outer portion is composed of a polymeric material.

In some implementations, the first and second annular seals each comprise a metallic ring configured to be openable for installation about the piston plug and closable in an installed position. In some implementations, the metallic ring is composed of steel. In some implementations, the metallic ring is composed of Nitronic® 60. In some implementations, the metallic ring is composed of graphite coated stainless steel or hardened steel.

In some implementations, the first and second annular seals each comprise a solid ring, and the piston plug comprises a central portion and two opposed end portions configured to be fixed onto either end of the central portion to thereby define corresponding grooves for receiving the first and second annular seals respectively, wherein the annular seals are mounted prior to fixing the two opposed end portions to the central portion.

In some implementations, the annular seals are composed of polytetrafluoroethylene (PTFE). In some implementations, the annular seals are composed of polyether ether ketone (PEEK).

In some implementations, the process stream is a bitumen froth stream and the measuring of the temperature of the bitumen froth stream is performed at a location that is at least 20 pipe diameters downstream of an adjacent upstream DSI heater. In some implementations, the process stream is a water stream and the measuring of the temperature of the water stream is performed at a location that is at least 5 pipe diameters downstream of an adjacent upstream DSI heater. In some implementations, adjacent DSI heaters are spaced apart by at least 40 pipe diameters.

In some implementations, there is provided a system for heating a process stream flowing through a pipeline and having variable heating requirements and flowing in a bitumen froth treatment operation, the system comprising:

a steam source for supplying steam;

a direct steam injection (DSI) heater coupled to the pipeline and comprising:

a diffuser extending into the process stream and comprising a tubular body having a proximal portion in fluid communication with the steam source and configured to receive steam therefrom, and a distal portion comprising a perforated injection section having outlets in fluid communication with the process stream for injecting the steam at sonic flow conditions, the outlets being arranged in multiple side-by-side rows on respective planes that are each perpendicular to a longitudinal axis of the tubular body;

a piston plug mounted within the tubular body of the diffuser and being configured to axially move between different positions within the tubular body, the piston plug comprising a plug body and at least a first annular seal and a second annular seal positioned at opposed ends thereof; and a displacement assembly coupled to the piston plug and configured to displace the piston plug axially within the tubular body of the diffuser;

a monitoring assembly coupled to the pipeline and being configured for determining heating requirements of the process stream; and a controller coupled to the monitoring assembly for receiving information therefrom, and coupled to the displacement assembly for controlling the position of the piston plug within the tubular body of the diffuser in response to the determined heating requirements to provide an open area of the outlets through which steam is injected into the process stream, wherein the controller is configured to:

axially displace the piston plug within the tubular body between different axial positions in a stepwise fashion to selectively cover or uncover a predetermined number of rows of outlets to provide the open area for steam injection, such that when one or more rows of outlets are completely covered:

the first annular seal is located in between and spaced apart from adjacent rows of outlets, and abuts against inner surfaces of the tubular body, and the second annular seal abuts against inner surfaces of the tubular body to inhibit steam from passing beyond the second annular seal toward the covered outlets so as to prevent cavitation.

In some implementations, the piston plug is configured to progressively cover the rows of outlets upon distal displacement within the tubular body, and wherein the plug body is tubular allowing passage of steam therethrough. In some implementations, the plug body comprises a distal groove configured to receive the first annular seal therein. In some implementations, the plug body comprises a proximal groove configured to receive the second annular seal therein. In some implementations, the first and second annular seals are spaced apart from each other by a separation distance that is greater than a length of the perforated injection section. In some implementations, the proximal and distal grooves have substantially the same dimensions as each other. In some implementations, the first and second annular seals have substantially the same dimensions as each other. In some implementations, the first annular seal has a width of about 0.125 inch to about 0.25 inch. In some implementations, the rows of outlets are arranged such that adjacent rows are spaced apart from each other by about 0.59 inch to about 0.75 inch. In some implementations, the rows of outlets are arranged such that adjacent rows are spaced apart from each other by a spacing distance between about twice to three times greater than a diameter of the outlets. In some implementations, the rows of outlets are arranged such that the rows are evenly spaced apart from each other. In some implementations, the rows of outlets comprise at least one distal end row at a distal end of the tubular body, and each distal end row has a smaller open area compared to the other rows. In some implementations, the distal end row has fewer outlets compared to the other rows. In some implementations, the distal end row has smaller outlets compared to the other rows. In some implementations, the outlets of the distal end row are each of the same size as the outlets in the other rows. In some implementations, the outlets of the rows proximal with respect to the distal end row are aligned longitudinally along an axis of the tubular body to form corresponding columns of outlets. In some implementations, the outlets of the distal end row are offset with respect to the columns of outlets along a circumference of the tubular body. In some implementations, the least one distal end row comprises two distal end rows of outlets.

In some implementations, the piston plug further comprises a connection mechanism for connecting the plug body to a displacement stem, and the second seal is located on the plug body distally with respect to the connection mechanism. In some implementations, the connection mechanism comprises apertures extending transversely through the plug body; a pin extending through the apertures and through a distal opening in the displacement stem, the pin having opposed ends that extend beyond the plug body; and securing members which couple to the opposed ends of the pin to secure the pin with respect to the plug body.

In some implementations, at least some components of the DSI heater are composed of 4140HT steel that is surface hardened using gas nitriding. In some implementations, at least the tubular body of the diffuser is composed of 4140HT steel that is surface hardened using gas nitriding. In some implementations, the first and second annular seals are composed of a same material.

In some implementations, the monitoring assembly comprises a temperature measurement device configured to measure a temperature of the process stream downstream of the DSI heater, and the controller is configured to compare the measured temperature with a target temperature, and determine a corresponding increase or decrease in steam injection via the DSI heater to achieve the target temperature. In some implementations, the controller is further configured to close a number of rows of outlets in response to a determined decrease in steam injection to achieve the target temperature by displacing the piston plug in a single step to the corresponding position; and open a number of rows of outlets in response to a determined increase in steam injection to achieve the target temperature by displacing the piston plug in a single step to the corresponding position.

In some implementations, multiple DSI heaters are provided in series for heating the process stream; and the multiple DSI heaters are controlled to provide an overall steam injection. In some implementations, multiple DSI heaters are provided in parallel. In some implementations, the multiple DSI heaters are provided in at least two parallel heating trains, each train comprising at least two of the DSI heaters. In some implementations, the parallel heating trains are configured to be operated alternately.

In some implementations, the process stream comprises a slurry stream. In some implementations, the process stream comprises a bitumen froth stream. In some implementations, the process stream comprises a hydrocarbon stream. In some implementations, the process stream comprises a process water stream. In some implementations, the process stream comprises a tailings stream. In some implementations, the bitumen froth treatment operation is a paraffinic froth treatment operation.

In some implementations, the DSI heater and the steam source are configured to provide the sonic flow conditions of the steam by substantially maintaining a constant steam velocity and providing the outlets with size and configuration for sonic flow. In some implementations, the steam source is configured to provide the steam to the diffuser having a steam temperature that is at least 10° C. superheated. In some implementations, the steam source is configured to provide the steam to the diffuser having a steam temperature that is between 10° C. and 25° C. superheated. In some implementations, the steam source is configured to provide a steam pressure of at least 2000 kPag. In some implementations, the steam source is configured to provide a steam pressure of at least 2200 kPag. In some implementations, the steam source is configured to provide a steam pressure between 2100 and 2950 kPag.

In some implementations, the first and second annular seals each comprise: an annular core; and an outer portion mounted about the annular core. In some implementations, the annular core is composed of metal. In some implementations, the annular core is spring loaded. In some implementations, the outer portion is composed of a polymeric material.

In some implementations, the first and second annular seals each comprise a metallic ring configured to be openable for installation about the piston plug and closable in an installed position. In some implementations, the metallic ring is composed of steel. In some implementations, the metallic ring is composed of Nitronic® 60. In some implementations, the metallic ring is composed of graphite coated stainless steel or hardened steel.

In some implementations, the first and second annular seals each comprise a solid ring, and the piston plug comprises a central portion and two opposed end portions configured to be fixed onto either end of the central portion to thereby define corresponding grooves for receiving the first and second annular seals respectively, wherein the annular seals are mounted prior to fixing the two opposed end portions to the central portion.

In some implementations, the annular seals are composed of polytetrafluoroethylene (PTFE). In some implementations, the annular seals are composed of polyether ether ketone (PEEK).

In some implementations, the process stream is a bitumen froth stream and the temperature measurement device monitoring the bitumen froth stream is provided at a location that is at least 20 pipe diameters downstream of an adjacent upstream DSI heater. In some implementations, the process stream is a water stream and the temperature measurement device monitoring the water stream is provided at a location that is at least 5 pipe diameters downstream of an adjacent upstream DSI heater. In some implementations, adjacent DSI heaters are spaced apart by at least 40 pipe diameters.

In some implementations, there is provided a direct steam injection (DSI) heater for heating a process stream in a bitumen froth treatment operation, the DSI heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam, the outlets being arranged in multiple side-by-side rows on respective planes that are each perpendicular to a longitudinal axis of the tubular body;

a piston plug mounted within the tubular body of the diffuser and being configured to axially move between different positions within the tubular body, the piston plug comprising a plug body and at least a first annular seal and a second annular seal positioned at opposed ends thereof, the piston plug being controllable within the tubular body of the diffuser to provide an open area of the outlets through which steam is injected into the process stream, by axially displacing the piston plug within the tubular body between different axial positions in a stepwise fashion to selectively cover or uncover corresponding rows of outlets to provide the open area for steam injection, such that when one or more rows of outlets are completely covered:

the first annular seal is located in between and spaced apart from adjacent rows of outlets, and abuts against inner surfaces of the tubular body, and the second annular seal abuts against inner surfaces of the tubular body to inhibit steam from passing beyond the second annular seal toward the covered outlets.

In some implementations, the outlets are sized and configured for injecting the steam at sonic flow conditions. In some implementations, the piston plug is configured to axially move in response to measured heating requirements of the process stream. In some implementations, the piston plug is configured to progressively cover the rows of outlets upon distal displacement within the tubular body, and wherein the plug body is tubular allowing passage of steam therethrough. In some implementations, the plug body comprises a distal groove configured to receive the first annular seal therein. In some implementations, the plug body comprises a proximal groove configured to receive the second annular seal therein. In some implementations, the first and second annular seals are spaced apart from each other by a separation distance that is greater than a length of the perforated injection section. In some implementations, the proximal and distal grooves have substantially the same dimensions as each other. In some implementations, the first and second annular seals have substantially the same dimensions as each other. In some implementations, the first annular seal has a width of about 0.125 inch to about 0.25 inch. In some implementations, the rows of outlets are arranged such that adjacent rows are spaced apart from each other by about 0.59 inch to about 0.75 inch. In some implementations, the rows of outlets are arranged such that adjacent rows are spaced apart from each other by a spacing distance between about twice to three times greater than a diameter of the outlets. In some implementations, the rows of outlets are arranged such that the rows are evenly spaced apart from each other. In some implementations, the rows of outlets comprise at least one distal end row at a distal end of the tubular body, and each distal end row has a smaller open area compared to the other rows. In some implementations, the distal end row has fewer outlets compared to the other rows. In some implementations, the distal end row has smaller outlets compared to the other rows. In some implementations, the outlets of the distal end row are each of the same size as the outlets in the other rows. In some implementations, the outlets of the rows proximal with respect to the distal end row are aligned longitudinally along an axis of the tubular body to form corresponding columns of outlets. In some implementations, the outlets of the distal end row are offset with respect to the columns of outlets along a circumference of the tubular body. In some implementations, the least one distal end row comprises two distal end rows of outlets.

In some implementations, the piston plug further comprises a connection mechanism for connecting the plug body to a displacement stem, and the second seal is located on the plug body distally with respect to the connection mechanism. In some implementations, the connection mechanism comprises: apertures extending transversely through the plug body; a pin extending through the apertures and through a distal opening in the displacement stem, the pin having opposed ends that extend beyond the plug body; and securing members which couple to the opposed ends of the pin to secure the pin with respect to the plug body.

In some implementations, at least some components of the DSI heater are composed of 4140HT steel that is surface hardened using gas nitriding. In some implementations, at least the tubular body of the diffuser is composed of 4140HT steel that is surface hardened using gas nitriding. In some implementations, the first and second annular seals are composed of a same material.

In some implementations, the DSI heater is configured to provide the sonic flow conditions of the steam with the steam being maintained at a constant steam velocity. In some implementations, the DSI is configured to receive the steam at a steam temperature between 10° C. and 25° C. superheated and at a steam pressure between 2100 and 2950 kPag.

In some implementations, the first and second annular seals each comprise an annular core; and an outer portion mounted about the annular core. In some implementations, the annular core is composed of metal. In some implementations, the annular core is spring loaded. In some implementations, the outer portion is composed of a polymeric material.

In some implementations, the first and second annular seals each comprise a metallic ring configured to be openable for installation about the piston plug and closable in an installed position. In some implementations, the metallic ring is composed of steel. In some implementations, the metallic ring is composed of Nitronic® 60. In some implementations, the metallic ring is composed of graphite coated stainless steel or hardened steel.

In some implementations, the first and second annular seals each comprise a solid ring, and the piston plug comprises a central portion and two opposed end portions configured to be fixed onto either end of the central portion to thereby define corresponding grooves for receiving the first and second annular seals respectively, wherein the annular seals are mounted prior to fixing the two opposed end portions to the central portion.

In some implementations, the annular seals are composed of polytetrafluoroethylene (PTFE). In some implementations, the annular seals are composed of polyether ether ketone (PEEK).

In some implementations, there is provided a direct steam injection (DSI) heater for heating a process stream in a bitumen froth treatment operation, the DSI heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam;

a piston plug mounted within the tubular body of the diffuser and being configured to axially move between different positions within the tubular body to selectively cover or uncover outlets of the diffuser, the piston plug comprising:

a plug body having proximal and distal grooves; and at least a first annular seal and a second annular seal positioned at opposed ends of the plug body in respective grooves for engaging with the tubular body of the diffuser to inhibit steam from passing beyond the annular seals, wherein each annular seal comprises:

an annular spring-loaded core; and an outer portion mounted about the spring-loaded core and being biased thereby to facilitate sealing.

In some implementations, the outlets are arranged in multiple side-by-side rows on respective planes that are each perpendicular to a longitudinal axis of the tubular body. In some implementations, the piston plug is configured to axially move between different positions within the tubular body in a stepwise fashion to selectively cover or uncover corresponding rows of outlets to provide an open area for steam injection, such that when one or more rows of outlets are completely covered the first annular seal is located in between and spaced apart from adjacent rows of outlets, and abuts against inner surfaces of the tubular body, and the second annular seal abuts against inner surfaces of the tubular body to inhibit steam from passing beyond the second annular seal toward the covered outlets. In some implementations, the outlets are sized and configured for injecting the steam at sonic flow conditions. In some implementations, the piston plug is configured to axially move in response to measured heating requirements of the process stream. In some implementations, the piston plug is configured to progressively cover the rows of outlets upon distal displacement within the tubular body, and wherein the plug body is tubular allowing passage of steam therethrough. In some implementations, the plug body comprises a distal groove configured to receive the first annular seal therein. In some implementations, the plug body comprises a proximal groove configured to receive the second annular seal therein. In some implementations, the first and second annular seals are spaced apart from each other by a separation distance that is greater than a length of the perforated injection section. In some implementations, the proximal and distal grooves have substantially the same dimensions as each other. In some implementations, the first and second annular seals have substantially the same dimensions as each other. In some implementations, the first annular seal has a width of about 0.125 inch to about 0.25 inch. In some implementations, the rows of outlets are arranged such that adjacent rows are spaced apart from each other by about 0.59 inch to about 0.75 inch. In some implementations, the rows of outlets are arranged such that adjacent rows are spaced apart from each other by a spacing distance between about twice to three times greater than a diameter of the outlets. In some implementations, the rows of outlets are arranged such that the rows are evenly spaced apart from each other. In some implementations, the rows of outlets comprise at least one distal end row at a distal end of the tubular body, and each distal end row has a smaller open area compared to the other rows. In some implementations, the distal end row has fewer outlets compared to the other rows. In some implementations, the distal end row has smaller outlets compared to the other rows. In some implementations, the outlets of the distal end row are each of the same size as the outlets in the other rows. In some implementations, the outlets of the rows proximal with respect to the distal end row are aligned longitudinally along an axis of the tubular body to form corresponding columns of outlets. In some implementations, the outlets of the distal end row are offset with respect to the columns of outlets along a circumference of the tubular body. In some implementations, the least one distal end row comprises two distal end rows of outlets. In some implementations, the piston plug further comprises a connection mechanism for connecting the plug body to a displacement stem, and the second seal is located on the plug body distally with respect to the connection mechanism. In some implementations, the connection mechanism comprises apertures extending transversely through the plug body; a pin extending through the apertures and through a distal opening in the displacement stem, the pin having opposed ends that extend beyond the plug body; and securing members which couple to the opposed ends of the pin to secure the pin with respect to the plug body.

In some implementations, at least some components of the DSI heater are composed of 4140HT steel that is surface hardened using gas nitriding. In some implementations, at least the tubular body of the diffuser is composed of 4140HT steel that is surface hardened using gas nitriding.

In some implementations, the DSI is configured to receive the steam at a steam temperature between 10° C. and 25° C. superheated and at a steam pressure between 2100 and 2950 kPag.

In some implementations, the first and second annular seals are composed of same materials. In some implementations, the annular core is composed of metal. In some implementations, the outer portion is composed of a polymeric material. In some implementations, each annular seal is configured so as to be stretchable over an end of the piston plug for installation thereof in the corresponding grooves.

In some implementations, there is provided a direct steam injection (DSI) heater for heating a process stream in a bitumen froth treatment operation, the DSI heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam;

a piston plug mounted within the tubular body of the diffuser and being configured to axially move between different positions within the tubular body to selectively cover or uncover outlets of the diffuser, the piston plug comprising:

a plug body having proximal and distal grooves; and at least a first annular seal and a second annular seal positioned at opposed ends of the plug body in respective grooves for engaging with the tubular body of the diffuser to inhibit steam from passing beyond the annular seals, wherein each annular seal comprises a metal ring having a connector configured to allow the metal ring to be pulled open for installation about the plug body.

In some implementations, the outlets are arranged in multiple side-by-side rows on respective planes that are each perpendicular to a longitudinal axis of the tubular body. In some implementations, the piston plug is configured to axially move between different positions within the tubular body in a stepwise fashion to selectively cover or uncover corresponding rows of outlets to provide an open area for steam injection, such that when one or more rows of outlets are completely covered the first annular seal is located in between and spaced apart from adjacent rows of outlets, and abuts against inner surfaces of the tubular body, and the second annular seal abuts against inner surfaces of the tubular body to inhibit steam from passing beyond the second annular seal toward the covered outlets. In some implementations, the outlets are sized and configured for injecting the steam at sonic flow conditions. In some implementations, the piston plug is configured to axially move in response to measured heating requirements of the process stream. In some implementations, the piston plug is configured to progressively cover the rows of outlets upon distal displacement within the tubular body, and wherein the plug body is tubular allowing passage of steam therethrough. In some implementations, the plug body comprises a distal groove configured to receive the first annular seal therein. In some implementations, the plug body comprises a proximal groove configured to receive the second annular seal therein. In some implementations, the first and second annular seals are spaced apart from each other by a separation distance that is greater than a length of the perforated injection section. In some implementations, the proximal and distal grooves have substantially the same dimensions as each other. In some implementations, the first and second annular seals have substantially the same dimensions as each other. In some implementations, the first annular seal has a width of about 0.125 inch to about 0.25 inch. In some implementations, the rows of outlets are arranged such that adjacent rows are spaced apart from each other by about 0.59 inch to about 0.75 inch. In some implementations, the rows of outlets are arranged such that adjacent rows are spaced apart from each other by a spacing distance between about twice to three times greater than a diameter of the outlets. In some implementations, the rows of outlets are arranged such that the rows are evenly spaced apart from each other. In some implementations, the rows of outlets comprise at least one distal end row at a distal end of the tubular body, and each distal end row has a smaller open area compared to the other rows. In some implementations, the distal end row has fewer outlets compared to the other rows. In some implementations, the distal end row has smaller outlets compared to the other rows. In some implementations, the outlets of the distal end row are each of the same size as the outlets in the other rows. In some implementations, the outlets of the rows proximal with respect to the distal end row are aligned longitudinally along an axis of the tubular body to form corresponding columns of outlets. In some implementations, the outlets of the distal end row are offset with respect to the columns of outlets along a circumference of the tubular body. In some implementations, the least one distal end row comprises two distal end rows of outlets.

In some implementations, the piston plug further comprises a connection mechanism for connecting the plug body to a displacement stem, and the second seal is located on the plug body distally with respect to the connection mechanism. In some implementations, the connection mechanism comprises apertures extending transversely through the plug body; a pin extending through the apertures and through a distal opening in the displacement stem, the pin having opposed ends that extend beyond the plug body; and securing members which couple to the opposed ends of the pin to secure the pin with respect to the plug body.

In some implementations, at least some components of the DSI heater are composed of 4140HT steel that is surface hardened using gas nitriding. In some implementations, at least the tubular body of the diffuser is composed of 4140HT steel that is surface hardened using gas nitriding. In some implementations, the first and second annular seals are composed of same materials.

In some implementations, the DSI is configured to receive the steam at a steam temperature between 10° C. and 25° C. superheated and at a steam pressure between 2100 and 2950 kPag.

In some implementations, the metallic ring is composed of steel. In some implementations, the metallic ring is composed of Nitronic® 60. In some implementations, the metallic ring is composed of graphite coated stainless steel or hardened steel.

In some implementations, each annular seal is configured so as to be stretchable to an open position to be placed over an end of the piston plug for installation thereof in the corresponding groove.

In some implementations, the connector of each annular seal comprises a slit. In some implementations, the connector of each annular seal comprises an overlapping break. In some implementations, the connector and the metal ring have an integral one-piece structure. In some implementations, multiple metal rings are provided in side-by-side relation at each corresponding groove. In some implementations, two metal rings are provided at each corresponding groove.

In some implementations, there is provided a process for heating a process stream flowing in a bitumen froth treatment operation, the process comprising: injecting steam directly into the process stream via a direct steam injection (DSI) heater as defined above or herein; and axially displacing the piston plug within the tubular body between different axial positions to selectively cover or uncover corresponding rows of outlets to provide an open area for steam injection.

In some implementations, there is provided a process for heating a process stream flowing in a bitumen froth treatment operation, the process comprising:

injecting steam directly into the process stream via a direct steam injection (DSI) heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam, the outlets being arranged in multiple side-by-side rows on respective planes that are each perpendicular to a longitudinal axis of the tubular body; and a piston plug mounted within the tubular body of the diffuser and being configured to axially move between different positions within the tubular body, the piston plug comprising a plug body and at least a first annular seal and a second annular seal positioned adjacent opposed ends of the plug body;

axially displacing the piston plug within the tubular body between different axial positions to selectively cover or uncover corresponding rows of outlets to provide an open area for steam injection, such that when one or more rows of outlets are completely covered:

the first annular seal is located in between and spaced apart from adjacent rows of outlets, and abuts against inner surfaces of the tubular body; and the second annular seal abuts against inner surfaces of the tubular body to inhibit steam from passing beyond the second annular seal toward the covered outlets.

In some implementations, the piston plug is configured to progressively cover the rows of outlets upon distal displacement within the tubular body, and wherein the plug body is tubular allowing passage of steam therethrough. In some implementations, the plug body comprises a distal groove configured to receive the first annular seal therein. In some implementations, the plug body comprises a proximal groove configured to receive the second annular seal therein. In some implementations, the first and second annular seals are spaced apart from each other by a separation distance that is greater than a length of the perforated injection section. In some implementations, the proximal and distal grooves have substantially the same dimensions as each other. In some implementations, the first and second annular seals have substantially the same dimensions as each other. In some implementations, the first annular seal has a width of about 0.125 inch to about 0.25 inch. In some implementations, the rows of outlets are arranged such that adjacent rows are spaced apart from each other by about 0.59 inch to about 0.75 inch. In some implementations, the rows of outlets are arranged such that adjacent rows are spaced apart from each other by a spacing distance between about twice to three times greater than a diameter of the outlets. In some implementations, the rows of outlets are arranged such that the rows are evenly spaced apart from each other. In some implementations, the rows of outlets comprise at least one distal end row at a distal end of the tubular body, and each distal end row has a smaller open area compared to the other rows. In some implementations, the distal end row has fewer outlets compared to the other rows. In some implementations, the distal end row has smaller outlets compared to the other rows. In some implementations, the outlets of the distal end row are each of the same size as the outlets in the other rows. In some implementations, the outlets of the rows proximal with respect to the distal end row are aligned longitudinally along an axis of the tubular body to form corresponding columns of outlets. In some implementations, the outlets of the distal end row are offset with respect to the columns of outlets along a circumference of the tubular body. In some implementations, the least one distal end row comprises two distal end rows of outlets. In some implementations, the piston plug further comprises a connection mechanism for connecting the plug body to a displacement stem, and the second seal is located on the plug body distally with respect to the connection mechanism. In some implementations, the connection mechanism comprises: apertures extending transversely through the plug body; a pin extending through the apertures and through a distal opening in the displacement stem, the pin having opposed ends that extend beyond the plug body; and securing members which couple to the opposed ends of the pin to secure the pin with respect to the plug body.

In some implementations, at least some components of the DSI heater are composed of 4140HT steel that is surface hardened using gas nitriding. In some implementations, at least the tubular body of the diffuser is composed of 4140HT steel that is surface hardened using gas nitriding. In some implementations, the first and second annular seals are composed of a same material.

In some implementations, the process includes determining of the heating requirements of the process stream comprises: measuring a temperature of the process stream downstream of the DSI heater; comparing the measured temperature with a target temperature; and determining a corresponding increase or decrease in steam injection via the DSI heater to achieve the target temperature. In some implementations, the controlling of the piston plug within the tubular body of the diffuser comprises closing a number of rows of outlets in response to a determined decrease in steam injection to achieve the target temperature by displacing the piston plug in a single step to the corresponding position; and opening a number of rows of outlets in response to a determined increase in steam injection to achieve the target temperature by displacing the piston plug in a single step to the corresponding position.

In some implementations, multiple DSI heaters are provided in series for heating the process stream; and the multiple DSI heaters are controlled to provide an overall steam injection. In some implementations, multiple DSI heaters are provided in parallel. In some implementations, the multiple DSI heaters are provided in at least two parallel heating trains, each train comprising at least two of the DSI heaters. In some implementations, the parallel heating trains are operated alternately.

In some implementations, the process stream comprises a slurry stream, bitumen froth stream, a hydrocarbon stream, a process water stream, a tailings stream or another stream. In some implementations, the bitumen froth treatment operation is a paraffinic froth treatment operation.

In some implementations, the sonic flow conditions of the steam are provided by substantially maintaining a constant steam velocity and providing the outlets with size and configuration for sonic flow.

In some implementations, the steam provided from the steam source to the diffuser has a steam temperature that is at least 10° C. superheated. In some implementations, the steam provided from the steam source to the diffuser has a steam temperature that between 10° C. and 25° C. superheated. In some implementations, the steam provided from the steam source to the diffuser has a steam pressure of at least 2000 kPag. In some implementations, the steam provided from the steam source to the diffuser has a steam pressure of at least 2200 kPag. In some implementations, the steam provided from the steam source to the diffuser has a steam pressure of between 2100 and 2950 kPag.

In some implementations, the first and second annular seals each comprise an annular core; and an outer portion mounted about the annular core. In some implementations, the annular core is composed of metal. In some implementations, the annular core is spring loaded. In some implementations, the outer portion is composed of a polymeric material.

In some implementations, the first and second annular seals each comprise a metallic ring configured to be openable for installation about the piston plug and closable in an installed position. In some implementations, the metallic ring is composed of steel. In some implementations, the metallic ring is composed of Nitronic® 60. In some implementations, the metallic ring is composed of graphite coated stainless steel or hardened steel.

In some implementations, the first and second annular seals each comprise a solid ring, and the piston plug comprises a central portion and two opposed end portions configured to be fixed onto either end of the central portion to thereby define corresponding grooves for receiving the first and second annular seals respectively, wherein the annular seals are mounted prior to fixing the two opposed end portions to the central portion.

In some implementations, the annular seals are composed of polytetrafluoroethylene (PTFE). In some implementations, the annular seals are composed of polyether ether ketone (PEEK).

In some implementations, the process stream is a bitumen froth stream and the measuring of the temperature of the bitumen froth stream is performed at a location that is at least 20 pipe diameters downstream of an adjacent upstream DSI heater. In some implementations, the process stream is a water stream and the measuring of the temperature of the water stream is performed at a location that is at least 5 pipe diameters downstream of an adjacent upstream DSI heater. In some implementations, adjacent DSI heaters are spaced apart by at least 40 pipe diameters.

There is also provided a process for producing bitumen or a hydrocarbon material that includes the use of the DSI heater and/or systems or methods described herein.

DETAILED DESCRIPTION

Figure 1:
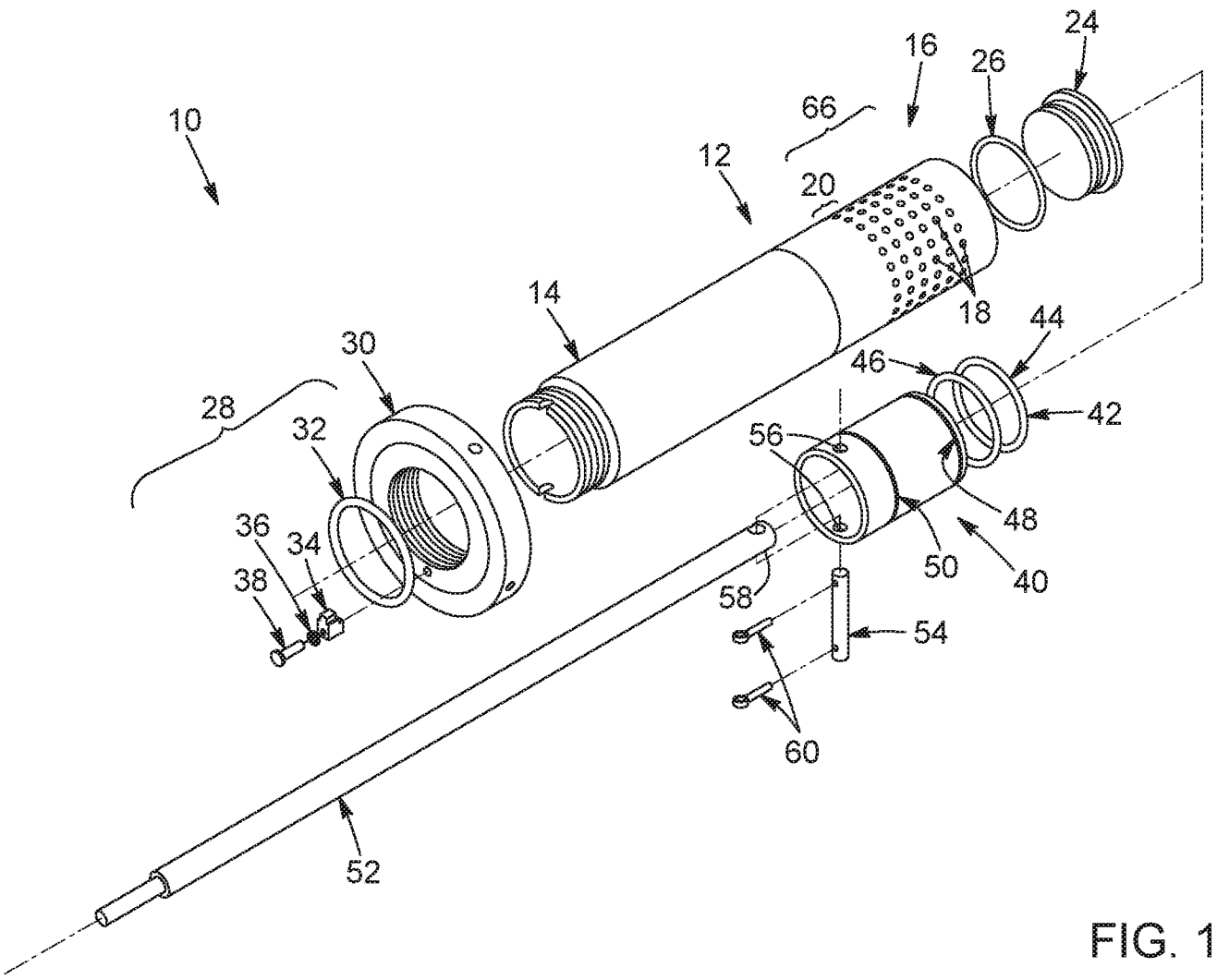
FIG. 1 is an exploded perspective view of an example DSI heater.

Various techniques are described herein for enhanced operation of direct steam injection (DSI) heating of process streams in bitumen froth treatment operations. For instance, DSI heaters with enhanced functionality particularly in terms of inhibiting steam leakage and associated equipment damage are described herein along with methods of implementing such heaters in bitumen froth treatment operations.

In some implementations, the DSI heating is performed using a DSI heater that has a diffuser having a distal portion with outlets for injecting steam into the process fluid and the outlets are arranged in multiple rows that are perpendicular to a longitudinal axis of the diffuser. The DSI heater can also include a piston plug that is mounted within the diffuser and is configured to axially move between different positions in order to enable blocking of certain rows of outlets of the diffuser to thereby enable control of steam injection in response to variable heating requirements of the process fluid. The piston can also include a dual sealing assembly including distal and proximal seals that are arranged around respective grooves in the piston plug. In some implementations, the distal seal as well as the rows of outlets of the diffuser are sized and positioned such that, in operation of the DSI heater, the piston is moved in a stepwise fashion ensuring that the distal seal sits in between adjacent rows of outlets of the diffuser, thereby preventing steam flowing through an outlet from directly impinging upon the seal or outlets being partially covered by the piston or seal. The proximal seal provides additional sealing ability to inhibit steam and condensate leakage that could promote cavitation and associated damage to components of the DSI heater. Various other structural features as well as methods of operation can also be used to enhance DSI heating.

It was found that DSI heaters that used a spiral outlet pattern for the diffuser and a sealing arrangement with only a distal seal experienced high degrees of cavitation and equipment wear in bitumen froth treatment operations. Such spiral, single-seal DSI heaters had to be replaced very frequently. By providing a dual seal assembly as well as outlets in the diffuser arranged in rows perpendicular to the longitudinal axis of the diffuser (which may also be referred to as "straight outlets"), the operational lifespan of the DSI heaters was significantly enhanced by several orders of magnitude. In addition, the DSI heaters were operated such that the piston plug with its dual seal assembly was displaced in a stepwise manner to ensure that the seals would never overlap any of the diffuser outlets but would rather sit in between or spaced away from adjacent rows of the outlets in all of the different positions the piston plug could take depending on the steam injection requirements. Thus, the control scheme used to modulate the steam injection rates in response to heating requirements were controlled to further prevent undue wear, equipment replacement and process downtime.

Referring to FIG. 1, an example DSI heater 10 is illustrated. The DSI heater 10 includes a diffuser 12 which includes a tubular body having a proximal portion 14 and a distal portion 16 with a plurality of steam outlets 18. The steam outlets 18 can also be referred to as holes or perforations. The steam outlets 18 are arranged in a pattern that enables the outlets 18 to be advantageously covered and thus blocked when lower steam heating requirements are desired while avoiding partial blockage of the outlets 18. For example, the outlets 18 can be arranged in a plurality of adjacent rows 20 where adjacent rows 20 are spaced apart to define respective non-perforated regions 22 therebetween. The diffuser 12 can also include at its distal end a diffuser end cap 24 which can be coupled to the end of the diffuser body, and an end cap O-ring 26 positioned in between the end cap 26 and the diffuser body for sealing functionality.

Still referring to FIG. 1, the proximal portion 14 of the diffuser body 12 can be configured to be coupled to an adapter assembly 28 that is connected to a steam supply line which supplies steam to the diffuser 12 of the DSI heater 10. The adapter assembly 28 can include an adapter flange 30, a retaining ring 32, a locking block 34, a split lock washer 36, and a bolt 38, but of course many other constructions are possible. The adapter flange 30 at the end of the proximal portion 14 of the diffuser 12 can have corresponding threads to facilitate mounting.

Still referring to FIG. 1, the DSI heater 10 also includes a piston plug 40, which can be configured as a hollow tube. The piston plug 40 also includes a sealing assembly 42 that includes distal and proximal seals 44, 46. In the implementation shown in FIG. 1, the distal and proximal seals 44, 46 are respectively mountable in distal and proximal grooves 48, 50 of the piston plug 40. The piston plug 40 is mountable within the diffuser 12 and can be displaced to various different positions such that in some positions a distal portion of the piston 40 covers one or more rows 20 of outlets 18, thereby preventing steam flow through the corresponding blocked rows of outlets.

The annular seals 44, 46 can each include a pair of sealing rings that sit within respective grooves of the piston plug 40. Other sealing structures or components can also be used instead of a pair of sealing rings.

The displacement of the piston plug 40 within the diffuser 12 can be achieved by various means. In some examples, the DSI heater 10 can include a stem 52 that is mounted to the piston plug 40 and can be axially displaced in order to move the piston 40 axially within the diffuser 12. The stem 52 can be mounted to the piston plug 40 by inserting a pin 54 through corresponding apertures 56 provided through the proximal portion of the piston 40, and preferably proximal with respect to the proximal groove and seal. The pin 54 also passes through an opening 58 provided through the corresponding end of the stem 52. The proximal end of the stem 52, in turn, can be coupled to a displacement device (not shown) that is capable of moving the stem 52 axially forward and backward. The pin 54 can then be secured in position where it passes through the apertures 56 and opening 58 by securing members 60 which can be pins, screws, bolts or other such structures. Alternatively, the piston 40 could also be displaced by mounting a section of it to the diffuser 12 or another component of the DSI heater in other ways.

Figure 2:
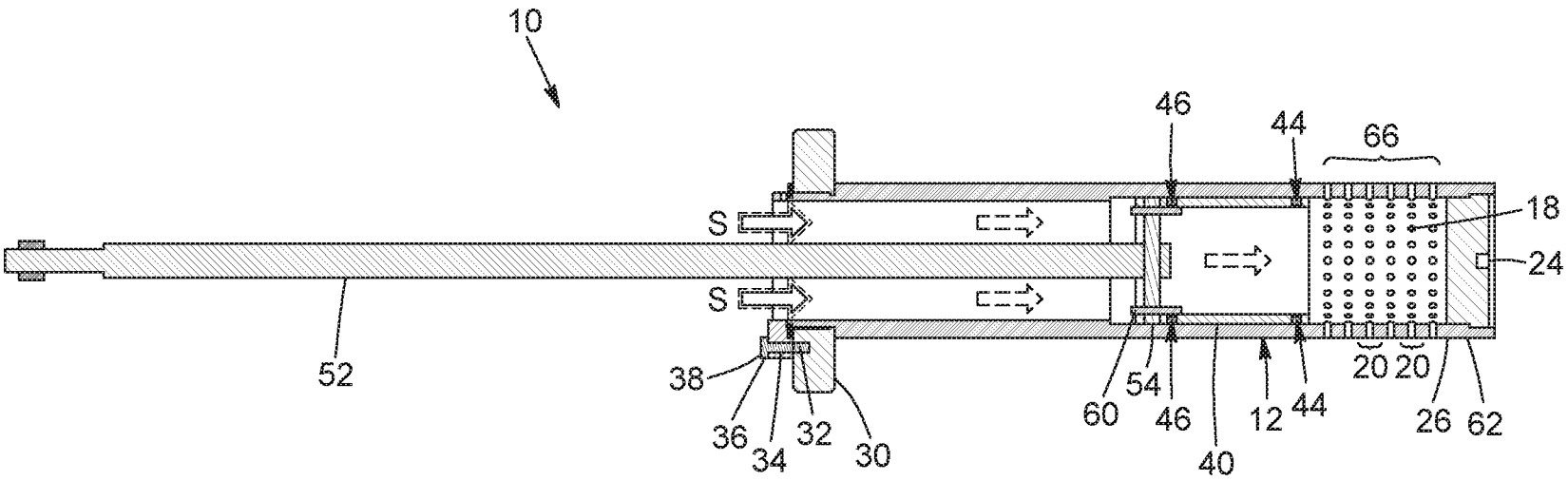
FIG. 2 is a cut view of an example DSI heater.

Referring to FIG. 2, the end cap 24 can be mounted within the distal end of the diffuser 12 by various means, such as by a screw inserted through the wall of the diffuser 12 and into the end cap 24. Other closure mechanisms can be used to close the end of the diffuser 12.

Referring to FIG. 2, the piston plug 40 is mounted within the diffuser 12 such that the seals 44, 46 provided in corresponding grooves abut against an inner surface of the diffuser 12. FIG. 2 illustrates the piston in a completely open position where all of the outlets 18 of the diffuser 12 are exposed (i.e., not covered by the piston plug 40) and thus in operation steam can flow through the interior of the diffuser 12 and piston plug 40, which are both tubular in construction, to reach and be expelled through all of the outlets 18. When the piston plug 40 is to be moved toward a closed position to reduce the amount of steam injected into the process stream, the piston plug 40 is displaced distally to cover one or more rows 20. In a close position where some outlets 18 are blocked, steam can still flow through the tubular diffuser 12 and piston plug 40 to reach the downstream open outlets 18. In FIG. 2, steam is schematically illustrated using dotted arrows.

Figure 9:
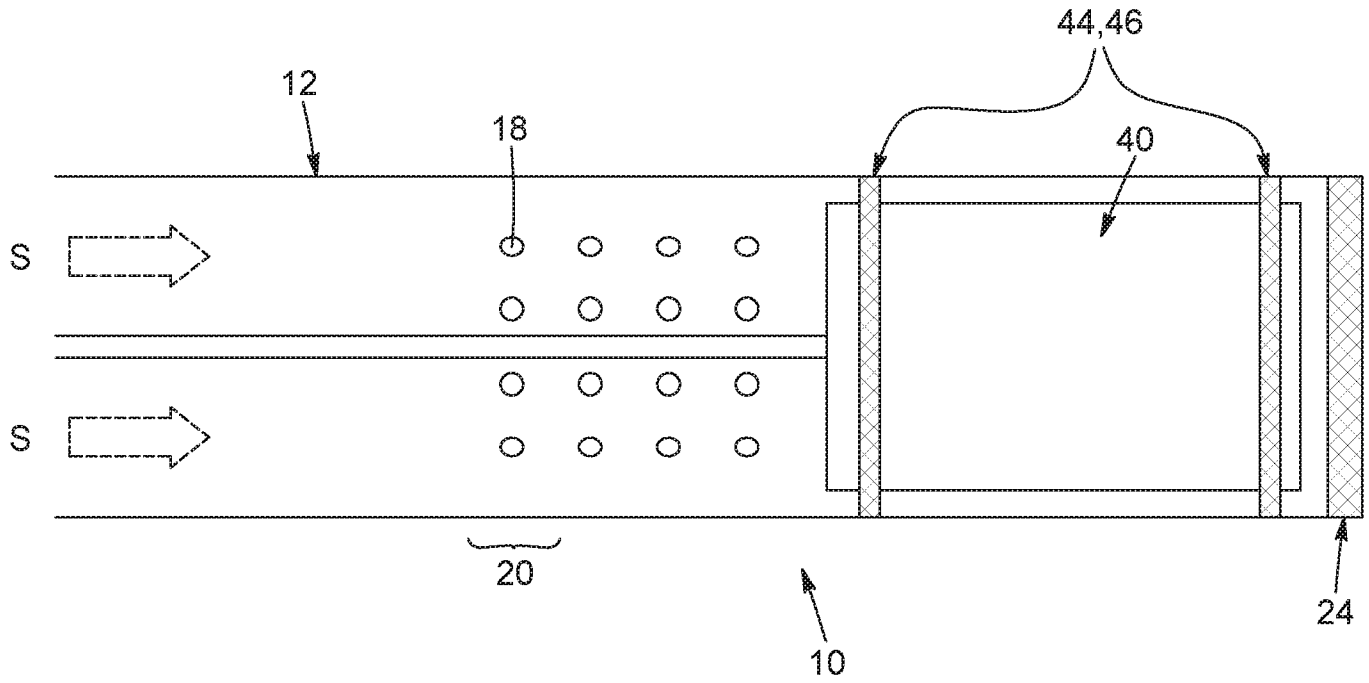
FIG. 9 is a side cut view schematic of part of a DSI heater having an alternative configuration.

Briefly referring to FIG. 9, in an alternative implementation, the piston plug 40 can be at a distal end of the diffuser 12 in the open position, and can then be displaced proximally to cover one or more rows of outlets 20. In this case, since the piston plug 40 is distal with respect to the outlets 18, the piston plug 40 need not be tubular and could be a solid structure or another construction where steam would not flow through it.

Referring back to FIGS. 1 and 2, in response to a reduction in heating requirements through a given DSI heater 10, the piston plug 40 can be axially displaced within the diffuser 12 toward its distal end, such that a distal portion of the piston plug 40 passes over and fully covers one or more rows 20 of outlets 18. Of course, the more rows 20 that the piston 40 covers, the fewer outlets 18 are exposed to be able to inject steam into the process fluid. Thus, blocking off rows 20 of outlets 18 reduces steam injection rates and corresponding heating of the process fluid. The steam velocity can be provided to be constant and thus the sonic steam flow via the outlets 18 is controlled through step changes that do not change the flow area or steam velocity, but rather the number of outlets 18 that are exposed for steam injection.

In some implementations, the steam provided to the diffuser 12 is superheated and can have a steam temperature that is at least 10° C. superheated, or between 10° C. and 25° C. superheated. The steam can have a steam pressure of at least 2000 kPag, at least 2200 kPag, or between 2100 and 2950 kPag, for example. The steam can have other properties and can be generated using various steam generation units and processes.

Figure 6:
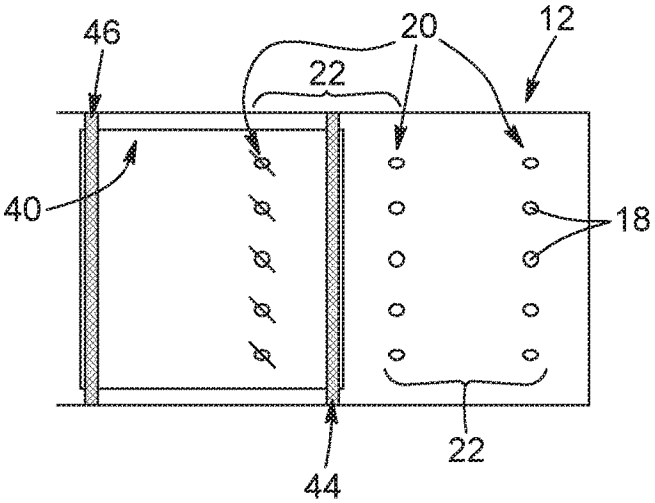
FIG. 6 is a side cut view schematic of part of a DSI heater.

Referring now to FIG. 6, the piston plug 40 can be axially displaced toward the distal end of the diffuser 12 and positioned such that the distal seal 44 is located in between two adjacent rows 20 of outlets 18, thereby blocking off upstream rows (illustrated in FIG. 6 with a line striking through the holes) while leaving the downstream rows 20 of outlets 18 open and free to receive and expel steam into the process fluid. Various features of the DSI heater—the movement of the piston 40 as well as the size and location of the distal seal 44, the rows 20 of openings 18, and the non-perforated regions 22 defined between the rows 20—are provided such that the seal 44 can sit entirely within the non-perforated region 22 and no part of the piston plug 40 partially blocks any outlets 18 while in position.

A stepwise control strategy is thus employed to move the piston 40 within the diffuser 12 and to ensure that rows 20 of holes 18 are never partially blocked or partially directly under the distal seal 44. The non-perforated regions 22, which can be simply solid sections of pipe, can have lengths sufficiently great such that the distal seal 44 can comfortably sit therein with enough distance between the distal seal 44 and adjacent outlets 18 to inhibit direct or high-velocity steam from impinging upon the distal seal 44 and thus increasing the likelihood of wear and failure. The distal seal 44 can be controlled to be positioned in the middle between two adjacent rows 20 such that it is equidistant between them, or such that it is located closer to one of the rows 20 than the other, e.g., closer to the upstream blocked holes rather than the downstream exposed holes to provide further distance away from the high-velocity steam injected into the process fluid. In addition, the non-perforated region 22 in between each row 20 of holes 18 can have the same dimensions, or can be different in some cases. When the dimensions (e.g., length) of the non-perforated regions 22 are different, the control scheme can be adjusted such that the stepwise displacement of the piston 40 within the diffuser 12 is performed to ensure that the distal seal 44 sits within each non-perforated region when it is moved to that position to vary steam injection.

Figure 5:
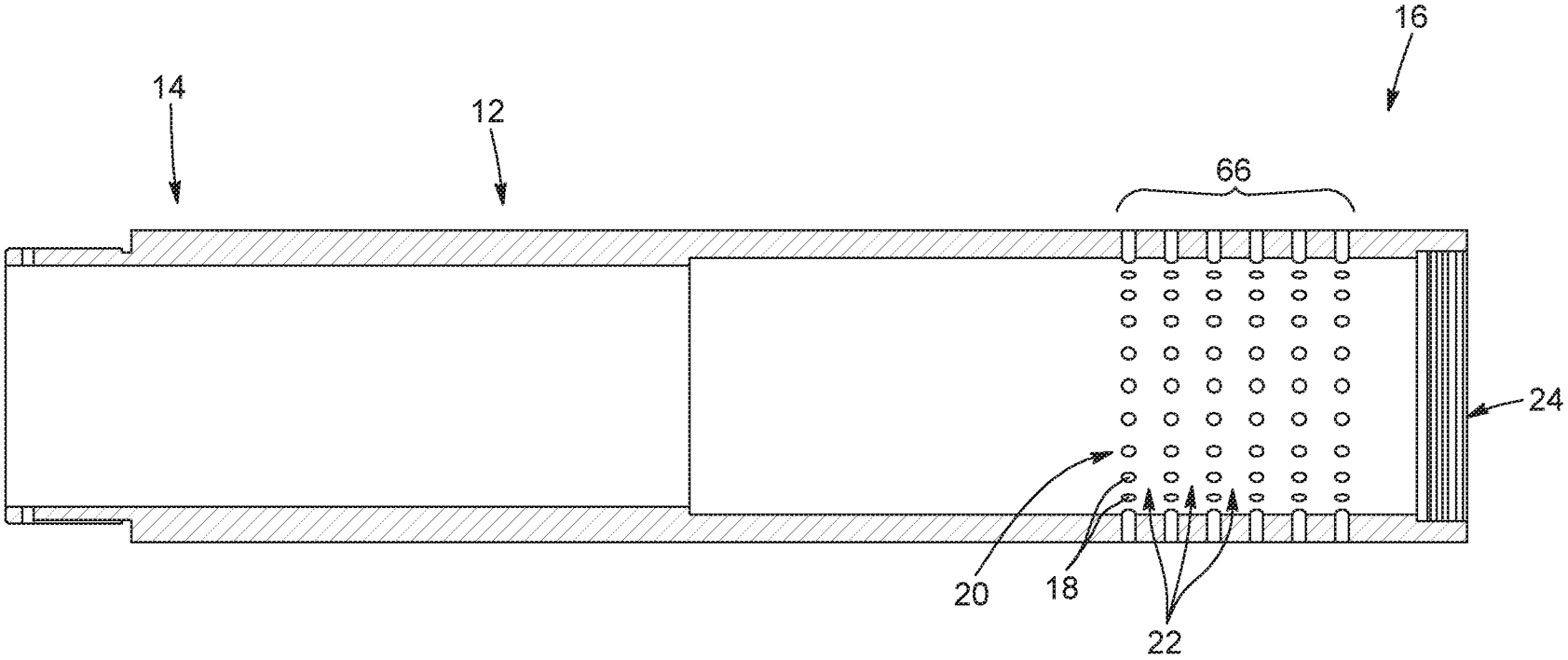
FIG. 5 is a cut view of a diffuser component that can be used in the DSI heater.

In some implementations, all of the rows 20 can have the same number of outlets 18 with the same outlet size and spacing, as illustrated in FIG. 5. Alternatively, the spacing between the rows 20 can be different, the size of the outlets can be different within each row and/or between rows, and the spacing between rows can be different. Corresponding control strategies can be designed and implemented for movement of the piston 40 in between each row or to different positions based on the various open areas defined by the different rows.

Figure 10:
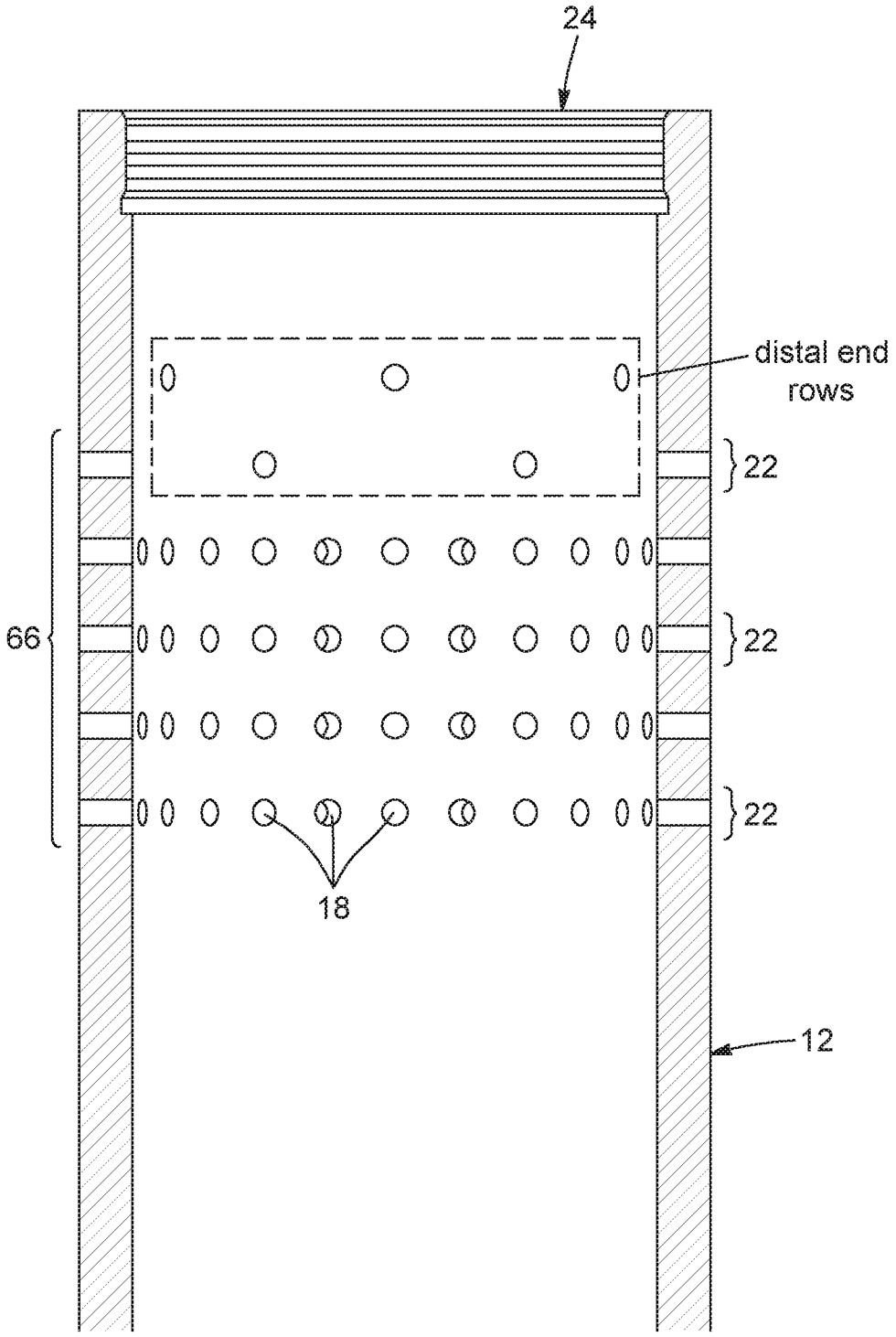
FIG. 10 is a side cut view of part of an example diffuser.

In one implementation, as shown in FIG. 10, one or more rows 20 at the distal-most end of the diffuser 12 has a smaller open area (e.g., by having fewer holes) to enable finer or very low steam injection rates when the heating requirements are relatively low for a given process stream. Relatively low injection rates or fine adjustments in injection rates can be desirable, for example, when multiple DSI heaters are used to heat a process stream and one DSI heat is used for finer adjustment of the heat input, or during turndown operations when a previously heated stream is recirculated and thus has only small heating requirements to maintain its temperature.

FIG. 10 shows two distal end rows that have fewer outlets compared to the more proximal rows. In this example, the two end rows have the same size of holes 18 as the other rows, they have the same number of holes 18 as each other, their holes 18 are offset from each other, and they each have an open area that is one quarter the open area of a proximal row. Here the "proximal" rows refer to the rows that are further upstream and have more holes 18 and/or a greater total open area, e.g., the first four rows in the example shown in FIG. 10. The holes 18 in the two distal end rows are also longitudinally aligned with certain columns of holes 18 formed by the proximal rows. In this example, there are four proximal rows and two distal end rows. The distal end rows can be provided so that if all of them are open, they provide a total steam injection that is lower than a single proximal row of outlets. In the illustrated example, if both distal end rows are open, they provide one half of the open area of a full proximal row. In alternative implementations, there could be three or four or more distal end rows with reduced open area, where each of those rows provides between 1/10 and 1/3 of the open area of a normal or proximal row.

In bitumen froth treatment operations, heating requirements can vary for various different process streams and for example during different stages of operations (e.g., start-up, ramp-up, turndown, normal operation). It can thus be relatively advantageous to have the ability to provide higher steam injection rates (e.g., when the piston plug is in the fully open position exposing all of the holes) and relatively low or trim heating injection rates (e.g., when the piston is close to a fully closed position but exposing a small amount of holes such as only the distal-most row). Since the holes are provided in rows, the last distal-most row or rows could be provided with relatively low open area to facilitate low steam injection rates when desired.

Figure 7:
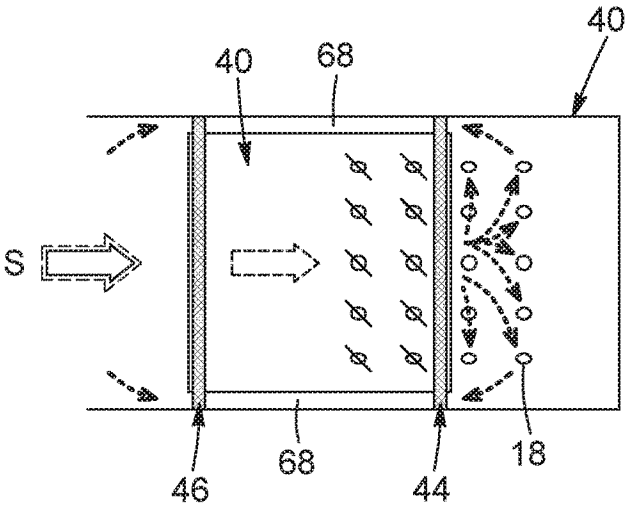
FIG. 7 is a side cut view schematic of part of a DSI heater.

FIG. 7 illustrates an example where two distal end rows 20 have fewer holes compared to the more proximal rows 20. Difference in open areas can be achieved by smaller holes or a fewer number of holes, or a combination thereof. However, the outlets 18 are preferably dimensioned to ensure sonic flow of the steam through the outlets 18, and thus it can be preferred for design and operation purposes to provide all outlets 18 having the same dimensions to ensure sonic flow conditions. In this case, the number of holes in the distal end 20 of the diffuser can be fewer than the more proximal rows 20.

It is also noted that when multiple DSI heaters are used to heat a given process stream, the DSI heaters can be the same or different in terms of construction and, in particular, open area per row 20. For example, a first DSI heater can be designed for higher steam injection rates and can thus have the size and number of outlets 18 to achieve high heating rates. A second DSI heater can be designed for trim or fine heat adjustments and can thus have fewer outlets 18 per row 20 to enable finer adjustments in injection rates. A plurality of DSI heaters can be provided in this manner where some or all of the DSI heaters have different open area constructions to provide different degrees of precision in terms of adjusting steam injection rates. The DSI heaters can be operated together using a central controller to adjust the appropriate piston plug(s) 40 of the DSI heaters in response to variations in the heating requirements.

It should also be noted that the piston plug 40 can be moved in stepwise fashion according to a number of pre-programmed displacements based on heating requirements, and the displacement can include one-step movements where the piston is moved in order to cover or uncover a single row 20 of outlets 18 or multiple rows 20 of outlets 18 in a single step. For example, when a slight reduction in heating is required for a given process stream, the piston plug 40 can be moved toward the distal end of the diffuser 12 in order to cover and therefore block a single row 20 of outlets 18 in a single step corresponding to the distance between two rows. For larger reductions in heating requirements the piston plug 40 can be displaced to pass over and cover two or more additional rows 20 in a single step.

In some implementations, as mentioned above, multiple DSI heaters can be provided for heating a single process stream, the heaters being provided in series or in parallel. Multiple DSI heaters can provide further heating patterns or variations for variable heating requirements of the process fluid, where at least one of the DSI heaters could be fully closed and thus injecting no steam while at least one other DSI heater is at least partially open to provide steam heating of the process fluid. A number of different permutations of piston plugs' positions in the respective DSI heaters can be provided to enable relatively precise heating of the process fluid.

Figure 4:
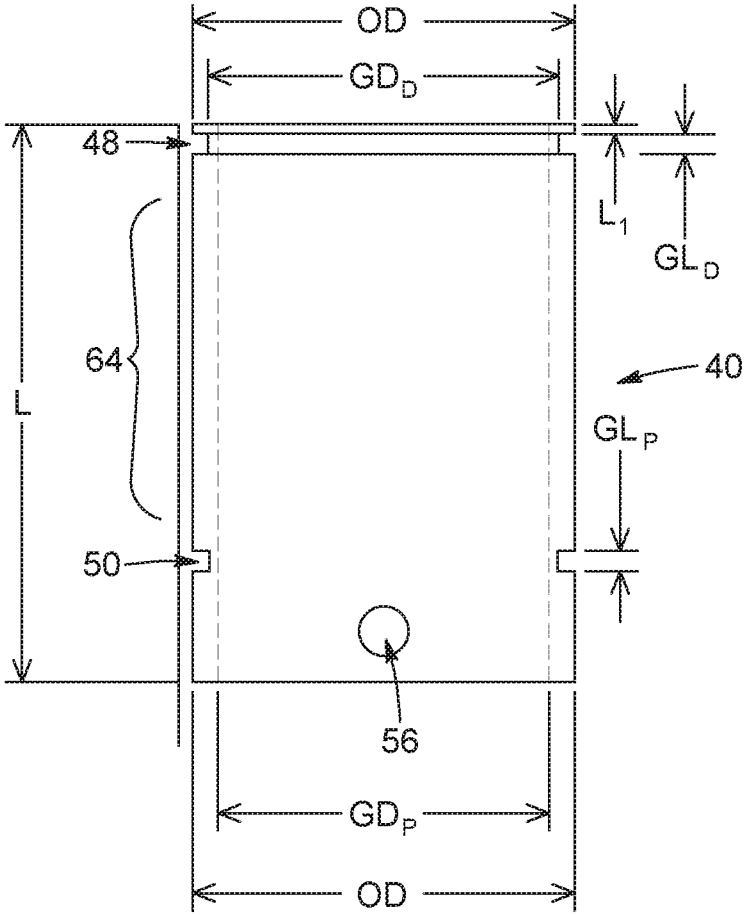
FIG. 4 is a side cut view of the piston component of FIG. 3.
Figure 3:
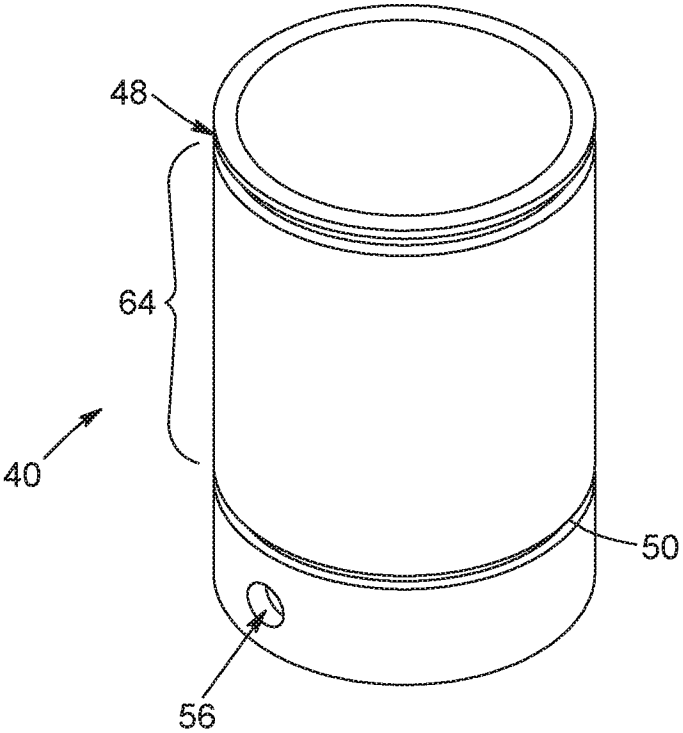
FIG. 3 is a perspective view of a piston component that can be used in a DSI heater.
Figure 8:
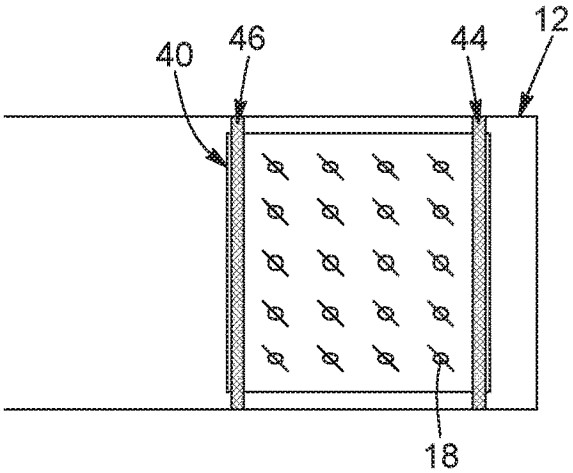
FIG. 8 is a side cut view schematic of part of a DSI heater.

Referring now to FIGS. 3 and 4, the piston plug 40 has an intermediate region 64 defined in between the two opposed grooves 48, 50. The intermediate region 64 can be sized such that its length is greater than a corresponding perforated section (66 in FIG. 5) which is defined as the region of the diffuser 12 that includes the outlets 18. In this arrangement, if the piston plug 40 is moved to the fully closed position, the distal seal will be located distally of the last row 20 of outlets 18 while the proximal seal will be located upstream of the first row 20 of outlets 18 of the diffuser 12. This general position and configuration can be seen in FIG. 8.

Referring now to FIG. 7, when the piston plug 40 is moved to a partially closed position where some of the outlets 18 are exposed for steam injection while others are blocked by the piston plug 40, the dual seal assembly including the distal and proximal seals 44, 46 can help prevent steam or condensate leakage into the intermediate region defined in between the seals and the diffuser and piston. Without the dual seal assembly where a seal or sealing functionality is provided both at proximal and distal locations of the piston plug 40, steam would be allowed to flow in between the piston 40 and the diffuser 12, which can lead to equipment wear and damage as well as steam leakage out of the outlets 18 that should be blocked by the piston plug 40. As can be seen in FIG. 7, steam can flow from the main interior cavity within the piston plug 40 and flow toward each of the proximal and distal seals 46, 44, but the seals are configured to inhibit significant steam or condensate to leak into the intermediate region 68.

Regarding the operation of displacing the piston plug 40 within the diffuser 12, the piston plug 40 can be moved from one position to another with sufficient speed to minimize contact of the distal seal 44 with the direct high-velocity flow of the steam, and thus the piston plug 40 can be moved so that the distal seal 44 moves rapidly past a row 20 of outlets 18 and does not linger over top, which could increase the risk of damage to the seal. The distal seal 44 also comes to rest in between adjacent rows 20 of outlets 18, while the distal end of the piston plug 40 is also located in between those same rows 20. In this regard, the distal seal 44 should be relatively close to the distal end of the piston plug 40 to prevent the distal end from overhanging into an adjacent row 20 of outlets 18, which could disrupt steam flow and could cause damage to the piston plug 40. The position of the proximal seal 46 does not have to be close to the proximal end of the piston plug 40, but should be sufficiently spaced away from the distal seal 44 so that it does not overlap any outlets 18 and remains upstream of the proximal-most row 20 of outlets 18 even in the fully closed position (e.g., shown in FIG. 8). If the piston plug 40 is relatively short, then the proximal seal 46 may have to be closer to the proximal end of the piston plug 40.

It should also be noted that the sealing assembly can include additional seals that may each be composed of multiple sealing rings that are mounted together or are slightly spaced apart from each other, but which still can rest within the non-perforated regions 22. In one example, a third seal (not illustrated) can be provided at some location of the piston plug 40 in between the proximal and distal seals 46, 44 in a position such that the third seal does not overlap with outlets 18 when the distal seal 44 is in its position in between two adjacent rows 20 of outlets 18. It should also be noted that the proximal seal 46 can itself include multiple sealing units that are arranged touching each other in a single groove or spaced apart from each other in respective grooves.

The DSI heater 10 can be mounted to a displacement device (not illustrated) which can include a motor that is coupled to a controller which is, in turn, coupled to a measurement or monitoring device that acquires information regarding the process stream. In some implementations, the monitoring device obtains a measurement, such as the temperature of the process stream, and provides this information to the controller which, in turn, implements a control strategy which can be based on a predetermined algorithm. The control setup can be based on a feed-back or feed-forward control paradigm. The controller can cause the motor to activate and thereby move the piston plug (e.g., via the stem 52 as per FIG. 1) to move toward a more open or closed position, depending on the heating requirements.

It should also be noted that various components of the DSI heaters 10, including the piston plug 40 and diffuser 12 can be composed of certain materials to further minimize wear and breakdown. For example, the diffuser 12 and/or piston plug 40 can be made from 4140HT steel and surface hardened using gas nitriding.

Figure 13:
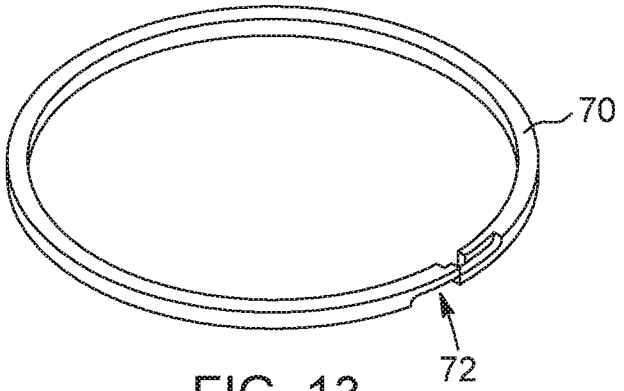
FIG. 13 is a perspective view of an example seal unit.
Figure 14:
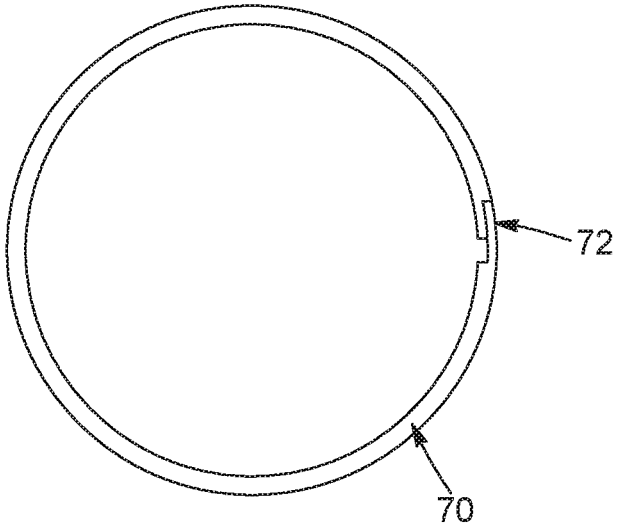
FIG. 14 is a top view of an example seal unit.
Figure 15:
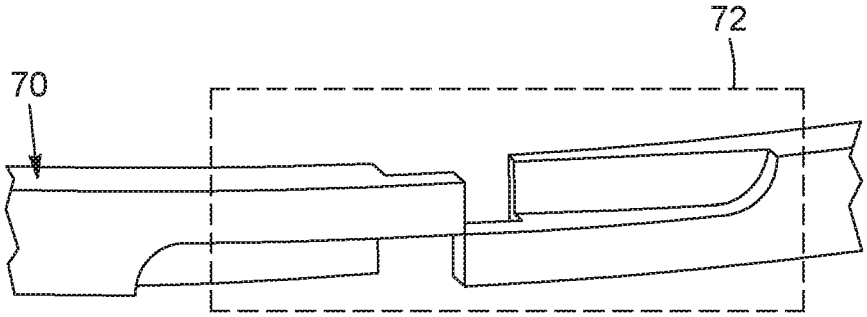
FIG. 15 is a perspective view of part of a seal unit showing an example connector.

The annular seals 44, 46 can have various constructions that can aid in sealing functionality and assembly. For example, FIGS. 13 to 15 illustrate an example seal unit that is constructed as a metal ring 70 with a connector 72 configured to connect two ends of the ring together. The connector 72 can include one or more mechanisms for connecting the ring 70 to form a solid annular structure when the seal unit is mounted in the groove of the piston plug. The connector can include a slit or overlapping break to allow the ring 70 to be pulled open and installed over top of the piston plug. The seal unit can be composed of metal and made to fit with high precision in the groove (e.g., groove 48 or 50 as per FIG. 1). In some examples, two rings 70 are used side by side within a single groove (e.g., groove 48 as per FIG. 1) of the piston plug, and the connectors 72 of the adjacent rings 20 are offset from each other. The rings 70 can be identical to each other or can have different widths. This type of configuration for the seal unit can facilitate mounting of the rings 70 within the groove 48, since the rings 70 can be disconnected to facilitate mounting about the groove 48 and then can be connected to form a solid ring 70 in position.

The connector 72 can include cooperative recesses and projections on the ends of the ring that can fit with respect to each other when the ring is in a close position and can be slid or decoupled from each other when the ring is opened to an open position during installation into the corresponding groove of the piston plug. As shown in FIG. 15, the two cooperating ends of the ring can have different yet cooperating configurations. On a first end (see left side of figure), there may be a recess on one side and a projection on the other side extending forward toward the opposed second end of the ring. On the second end, there may be a projection on the same side as the recess of the first end and it can be configured to fit or slide into at least part of the recess, and can for a flush closed part that has a same or similar cross-section as the other parts of the ring. Similarly, the second end can have a recess on the same side as the projection of the first end for cooperating therewith. The recesses and projections can be sized and configured so that the projections completely fill the recesses in the closed position, and thus the connector is like the other parts of the ring. Alternatively, recesses and projections can be sized and configured so that in the closed position there are still one or more recess portions, which can be used to help re-open the ring during replacement or maintenance. Of course, various other structures and configurations are also possible for the ring seals and the connectors.

The metal ring 70 can be composed of various materials, such as austenitic alloys such as Nitronic® 60, graphite coated stainless steel or hardened steel. Other high temperature designed metals or alloys, with or without coatings, can be used.

Figure 11:
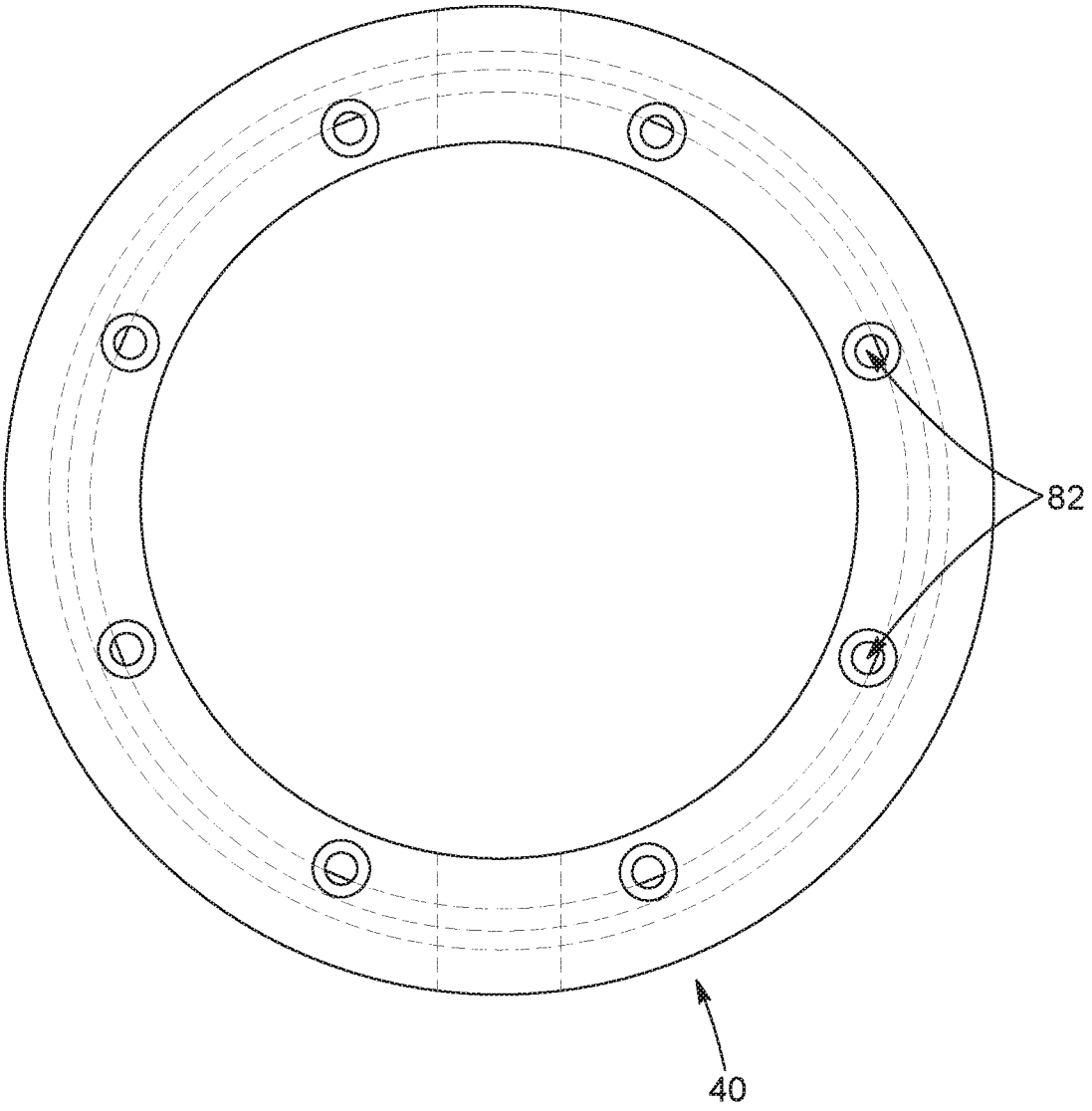
FIG. 11 is a top partial transparent view of a piston plug with top and bottom lips portions.
Figure 12:
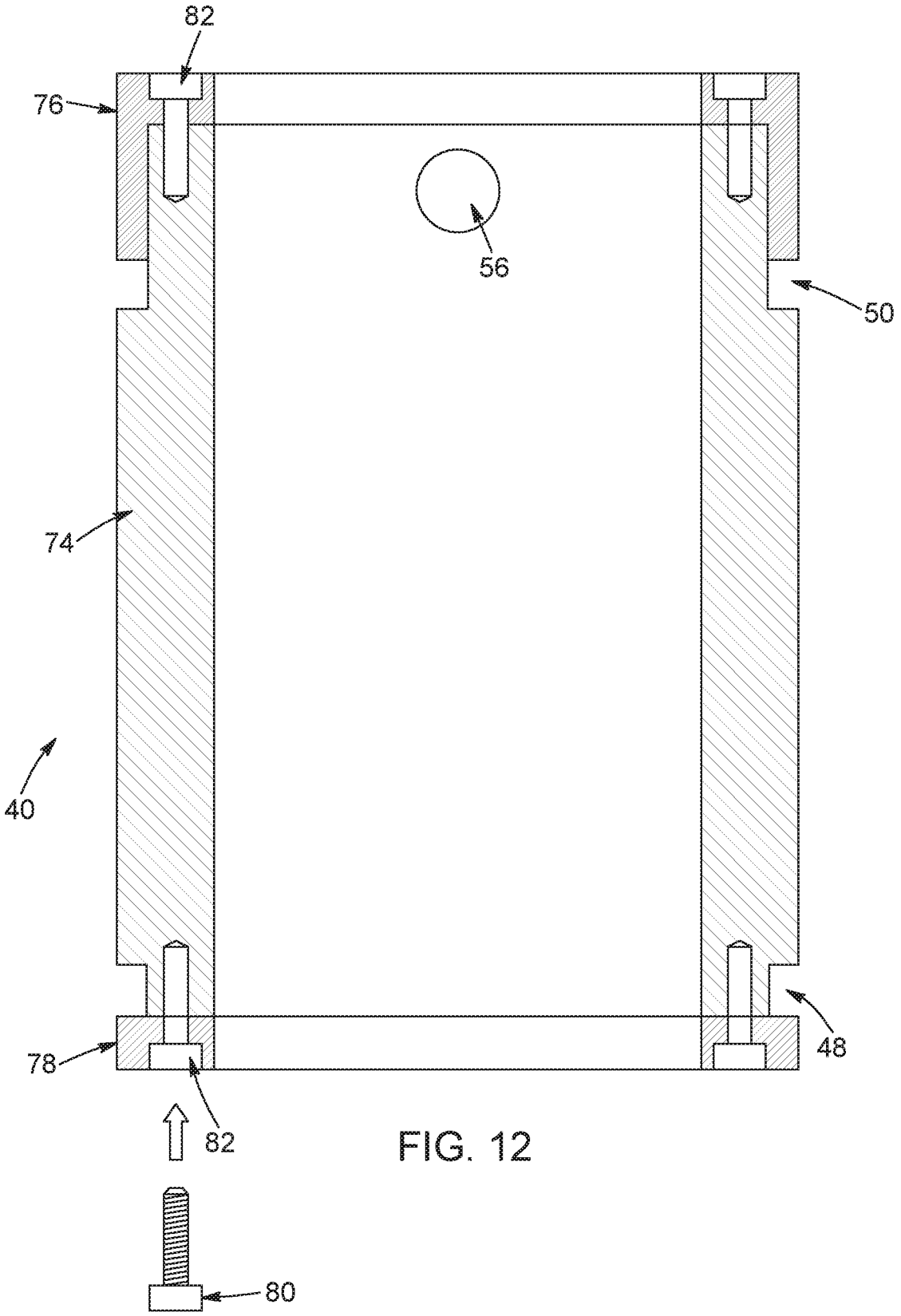
FIG. 12 is a side cut view of a piston plug with top and bottom lips portions.

Turning to FIGS. 11 and 12, the seal units can also be made without connectors so that they have a solid ring structure for mounting in the grooves 48, 50. When the rings cannot be "opened" for assembly with the piston plug 40, the piston plug 40 can be constructed to facilitate assembly. For instance, the piston plug 40 can be made to have a central piston portion 74, and two opposed end portions 76, 78 that are mounted to opposed ends of the central piston portion 74 via mounting bolts 80 or the like that are mounted through corresponding apertures 82 extending into the end portions 76, 78 and central portion 74, as shown in FIG. 12. Thus, when the end portions 76, 78 are removed from the central portion 74, the rings (not shown here) can be provided over the central portion 74 and into locations were the grooves 50, 48 are defined once the end portions 76, 78 are mounted onto the central portion 74. The end portions 76, 78 can have different structures and forms, depending on the location of the grooves 50, 48 to be defined. In addition, the piston plug 40 can be constructed to have sufficient wall thicknesses and other features that facilitate the construction shown in this example. It is also noted that multiple rings can be mounted in side-by-side relation within a single groove 48 in this example construction. The seal units used with such piston plugs 40 can be composed of PTFE or PEEK materials that are made to have a tight tolerance fit, and thus the bolted or screwed top and bottom lip portions on the central piston portion 74 can facilitate assembly as well as replacement of the seals, if desired.

Figure 16:
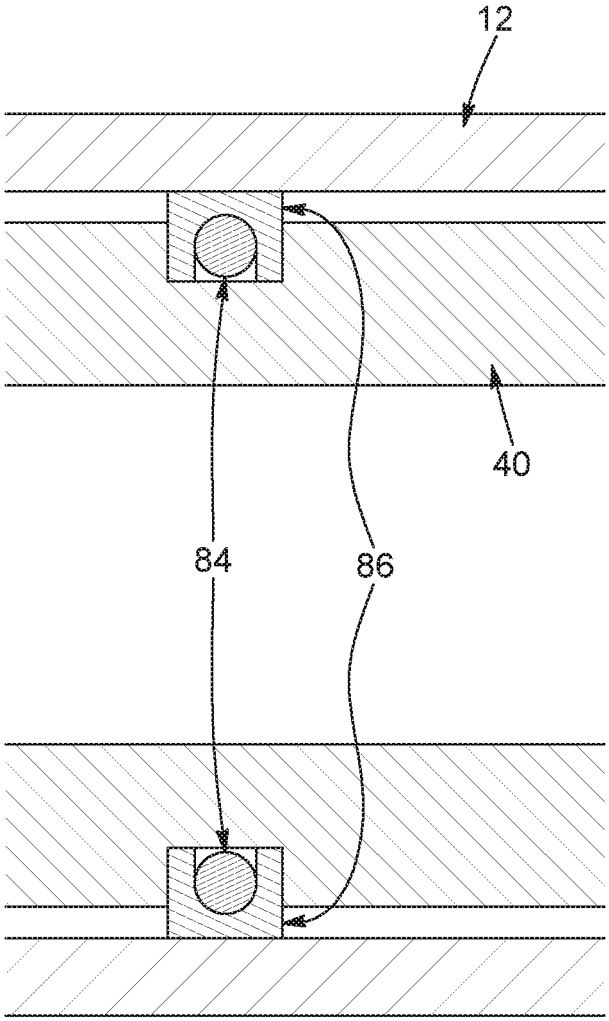
FIG. 16 is a side cut view of part of diffuser and piston plug showing an example seal unit with a core and an outer portion.

Turning now to FIG. 16, another example seal unit is illustrated in a mounted position between the piston plug 40 and the diffuser 12. In this example, each seal can include an annular core 84 and an outer portion 86 that can be mounted about the annular core 84. This construction can enable certain functionalities, particularly when the core 84 and the outer portion 86 have different functional properties. In some implementations, the annular core 84 is a spring-loaded core and/or the outer portion 86 is a resilient polymeric portion. The spring-loaded core 84 can provide a force that pushes against the outer portion 86 to facilitate sealing contact against the inner wall of the diffuser 12 and other surfaces where sealing is desired. This spring-load seal unit design facilitates providing a working load against the diffuser wall to seal against manufacturing inconsistencies in dimensional tolerances, for example. Various different spring constructions and configurations can be provided. This example type of seal unit can be advantageous when the diffuser 12 and piston plug 40 are manufactured with lower precision, and thus the seal unit has to adapt to changes in tolerance to maintain a desired sealing effect. While the metal ring type seals shown in FIGS. 13 to 15 provide good sealing for high precision manufactured components, they may not provide as consistent a seal when used with diffuser 12 and piston plug 40 components having higher variance over the length where sealing is required. Thus, for diffuser 12 and piston plug 40 components having higher variance along the length where sealing is required, the spring-type composite seals can be advantageous to adapt to such variations.

It is also noted that internal surfaces and hole edges of the diffuser 12 can be smoothed to inhibit wear of the seal units passing over the holes 18. Other internal surfaces can also be smoothed, and the manufacturing of the piston plug 40 and the diffuser 12 can be performed to provide the desired precision and tolerance depending on the type and construction of the seals to be used.

Figure 17:
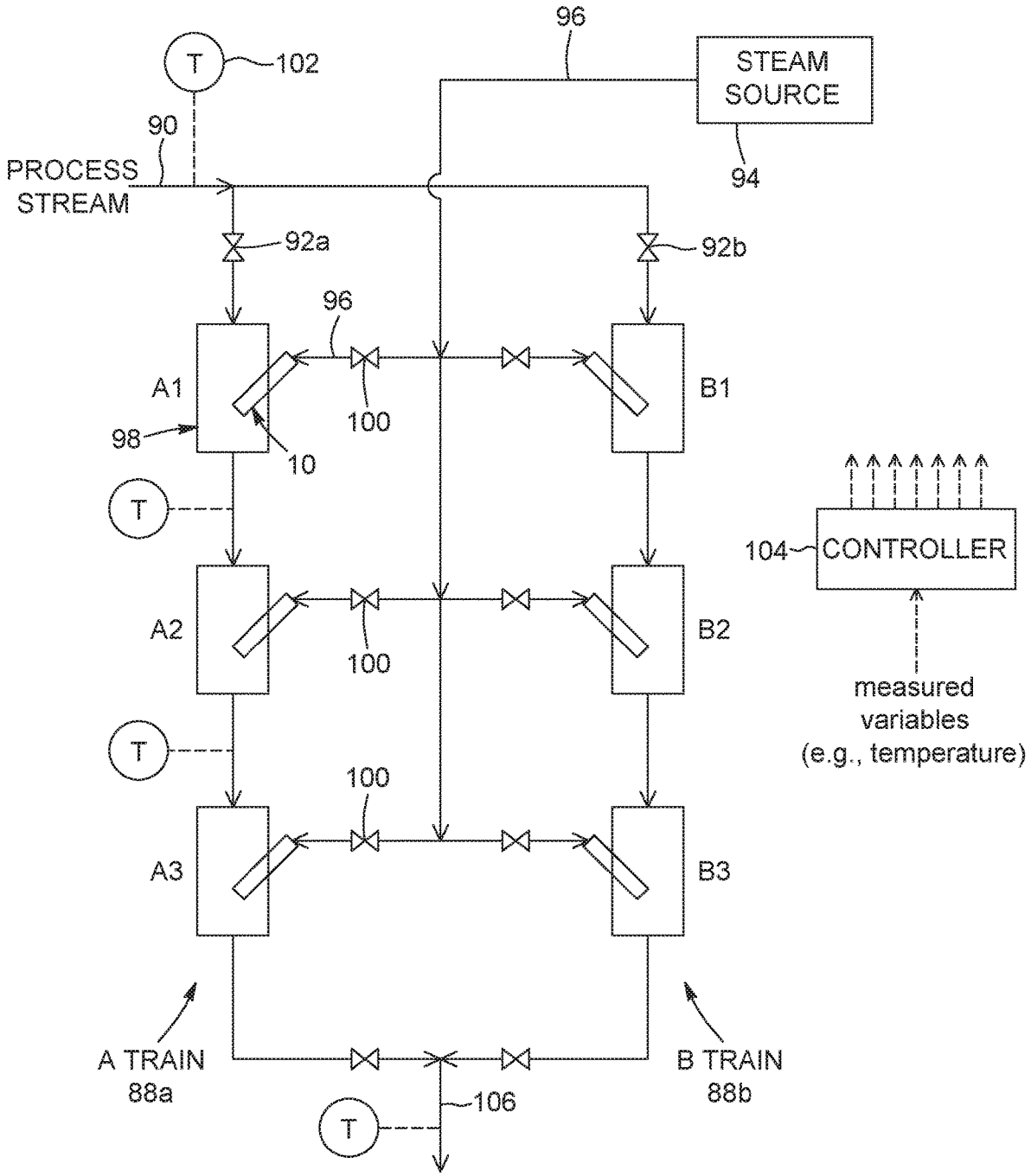
FIG. 17 is block diagram of an example DSI heating system with multiple parallel trains.

Referring to FIG. 17, the DSI heating of a process stream can be controlled according to various DSI arrangements. In FIG. 17, the DSI heating system includes two parallel trains 88*a*, 88*b* of multiple DSI heaters 10. The trains 88*a*, 88*b* can be identical to each other in terms of the piping, number of DSI heaters 10, and other features, or they can be different. In an example operating setup, the process stream 90 is supplied from a main line and is fed into one of the trains, while the other train is on standby. Of course, multiple parallel trains could also be operated simultaneously, if desired. Primary inlet valves 92*a*, 92*b* are used to control which train is active. A steam source 94 is provided for supplying steam 96 to the DSI heaters 10.

Each DSI heater 10 is mounted to the process line to extend into a heating conduit 98 through which the process stream flows. Steam valves 100 are controlled to supply steam to each of the operating DSI heaters 10 of a given train. Each train can include multiple DSI heaters 10, e.g., two, three, four, or five heaters. In the illustrated implementation, three DSI heaters 10 are provided in series for each train. Not all DSI heaters 10 of a given train are necessarily operated at any given time (e.g., two DSI heaters can be on while one is off). The two parallel trains 88*a*, 88*b* can be fully redundant so that only one is operating at a time. Trains 88*a*, 88*b* can be switched when maintenance or heater replacement is needed on one or more DSI heaters 10 or other equipment.

For the operating train, the upstream DSI heater (e.g., A1) can be used to provide the bulk of the heating and may often be fully open during normal operations, while downstream DSI heaters (e.g., A2, A3) are partially closed to provide partial or trim heating. During certain operating times, such as turndown, the first DSI heater 10 can also be partially closed.

DSI heaters 10 of a given train can be operated based on heating requirements, and the rows of outlets of the DSI heaters can be opened or closed to enable various steam injection levels through different combinations positioning the piston plugs. For example, two DSI heaters 10 can have end rows 20 with fewer holes 18 (e.g. as shown in FIG. 10), such that (i) a low level of heating is enabled by exposing only one end row 20 of one DSI heater 10, (ii) a slightly higher level of heating is enabled by exposing only one end row 20 of two DSI heaters 10 and (iii) a higher level of heating is enabled by exposing the end row 20 and one proximal row 20 of only one DSI heater 10 (thus closing the end row 20 of the other DSI heater 10), and so on. The end rows 20 with fewer outlets 18 can each be provided to have a quarter of the open area compared to a regular row, thus enabling ¼, ½, or ¾ of the steam injection of a proximal row by respectively opening one, two or three distal end rows 20 of the two DSI heaters 10. Of course, other configurations and process control schemes can be used.

By way of example, referring to FIG. 17, during normal operations A1 can be fully open while A2 is partially open and A3 is fully closed. Temperature measurements can be taken upstream (for feedforward control) or downstream (for feedback control) or both. If a slight increase in heating requirements is determined, then A3 can be opened to expose only one end row of outlets, particularly if A2 is already operating in the normal row range. In some implementations, DSI heaters 10 are provided such that the typical heating requirements of the process stream are such that at least one of the DSI heaters 10 can operate mainly with slight adjustments around the distal end rows, which can facilitate precision heating.

Still referring to FIG. 17, there may be one or more temperature measurement devices 102 provided within the overall DSI heating system, some of which are illustrated. A controller 104 can also be provided and configured to receive input variables (e.g., temperature measurements) and can control various aspects of the heating (e.g., steam valves, input valves, piston plug location for each DSI heater, etc.). As shown in FIG. 17, the DSI heating system produces a heated process stream 106 exiting the operating train, which in this figure is train A (88*a*) as corresponding valves for train B (88*b*) are closed.

Still referring to FIG. 17, the temperature control strategy can include positioning of the temperature measurement devices 102 depending on the nature and viscosity of the fluid to be heated to ensure sufficient mixing and accurate measurements. For example, for bitumen froth streams, temperature measurement devices can be located at least 20 pipe diameters downstream of a given DSI heater 10, and adjacent DSI heaters 10 (e.g., A1 and A2; A2 and A3) can be positioned 40 pipe diameters away from each other. This spacing facilitates good mixing of steam into the process fluid to be heated, so that temperature measurements are accurate and steam pockets are minimized. The spacing can vary depending on the viscosity of the process fluid. For water streams, the spacing can be closer than for bitumen froth, e.g., the temperature measurement devices 102 can be located at least 5 pipe diameters downstream of a given DSI heater 10, and adjacent DSI heaters 10 can be positioned 20 pipe diameters away from each other. More generally, the temperature measurement devices 102 can be located at a predetermined location or minimum spacing downstream of a corresponding DSI heater 10; and adjacent DSI heaters 10 can be positioned to have a predetermined spacing away from each other.

As noted throughout the present description, the DSI heater 10 can be implemented in a bitumen froth treatment operation for heating various process streams during various phases of the process. In a bitumen froth treatment operation, there are various stages of the process that may require or benefit from different DSI heating strategies. For example, during start-up operations, the process fluids may be relatively cold and therefore need to be supplied with higher thermal energy and thus during start-up periods all DSI heaters 10 may be turned to the fully open positions to provide the maximum steam injection. During normal operation, certain process streams may have variable heating requirements due to varying compositions (e.g., bitumen froth) or upstream variations, and thus slight adjustments by moving the piston plug 40 may be performed for one or more DSI heaters 10 to respond to the variable heating demands. During turn-down operations where hot fluids may be recirculated for a period of time, heating requirements may be minimal and thus during this phase of process operations the DSI heaters 10 can be operated in a more closed position, e.g., where some DSI heaters 10 are fully closed while others are mostly closed with only a low amount of trim heating being provided to the process fluid to keep it at a relatively constant temperature until normal operations are resumed.

In addition, various process streams in a bitumen froth treatment operation can be heated using the DSI techniques disclosed herein. For example, water, oil and slurry type streams can be heated using DSI heaters 10. Example streams include bitumen froth, process water, diluted bitumen, and diluted tailings streams. Furthermore, the DSI heaters 10 can be implemented in various bitumen froth treatment processes, such as paraffinic froth treatment and naphthenic froth treatment. The DSI heaters 10 can also be implemented in the context of other hydrocarbon extraction or recovery processes where direct steam heating can be used for heating slurry streams, hydrocarbon streams, water streams, and other process streams.

In terms of results that have been observed in a commercial bitumen froth treatment operation, an example of the DSI heater 10 described herein was implemented to replace a DSI heater that used spiral holes in a diffuser and did not have a proximal seal for the piston plug. After investigation of failures observed for the spiral single-seal heater, it was found that steam slippage between the wall clearance between the piston plug and diffuser lead to a high velocity zone between the piston plug and the diffuser, which resulted in high velocity steam erosion. High pressure steam (e.g. above 1500 kPa) supplied to the heater was thus able to slip within the gap and cause rapid damage to the system.

The redesigned DSI heater 10, which included the dual seal assembly as well as straight rows 20 of outlets 18 and the stepwise operation as described herein, enabled significant improvements in terms of preventing steam slippage and cavitation while reducing wear and avoiding frequent replacement requirements for the DSI heater 10 operated with high pressure steam injected under sonic flow conditions. In commercial operations where an example of the improved DSI heater 10 has been implemented, successful elimination of damage mechanisms previously identified and prolonging the life of the equipment were achieved. For example, the DSI heaters 10 went from requiring full replacement in less than one week to running over 2,000 hours with little to no notable process control degradation.

Examples of the DSI heater 10 and its implementation described herein facilitated elimination of steam erosion and cavitation damage mechanisms that had been causing accelerated damage of heater equipment beyond repair. The enhanced DSI heater design and operation facilitated significant improvements in DSI heating in bitumen froth treatment operations.

The invention claimed is:

1. A process for heating a process stream having variable heating requirements and flowing in a bitumen froth treatment operation, the process comprising:

injecting steam directly into the process stream via a direct steam injection (DSI) heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam at sonic flow conditions, the outlets being arranged in multiple side-by-side rows on respective planes that are each perpendicular to a longitudinal axis of the tubular body; and a piston plug mounted within the tubular body of the diffuser and being configured to axially move between different positions within the tubular body, the piston plug comprising a plug body and at least a first annular seal and a second annular seal positioned adjacent opposed ends thereof;

determining heating requirements of the process stream; and controlling the position of the piston plug within the tubular body of the diffuser in response to the determined heating requirements to provide an open area of the outlets through which steam is injected into the process stream, wherein the controlling comprises:

axially displacing the piston plug within the tubular body between different axial positions in a stepwise fashion to selectively cover or uncover a predetermined number of rows of outlets to provide the open area for steam injection, such that when one or more rows of outlets are completely covered:

the first annular seal is located in between and spaced apart from adjacent rows of outlets, and abuts against inner surfaces of the tubular body, and the second annular seal abuts against inner surfaces of the tubular body to inhibit steam from passing beyond the second annular seal toward the covered outlets so as to reduce cavitation.

2. The process of claim 1, wherein the piston plug is configured to progressively cover the rows of outlets upon distal displacement within the tubular body; and wherein the plug body is tubular allowing passage of steam therethrough.

3. The process of claim 1, wherein the plug body comprises a distal groove configured to receive the first annular seal therein and a proximal groove configured to receive the second annular seal therein; and wherein the first and second annular seals are spaced apart from each other by a separation distance that is greater than a length of the perforated injection section.

4. The process of claim 1, wherein the first annular seal has a width of about 0.125 inch to about 0.25 inch; the rows of outlets are arranged such that adjacent rows are spaced apart from each other by about 0.59 inch to about 0.75 inch; and the rows of outlets are arranged such that adjacent rows are spaced apart from each other by a spacing distance between about twice to three times greater than a diameter of the outlets.

5. The process of claim 1, wherein the rows of outlets comprise at least one distal end row at a distal end of the tubular body, each distal end row having a smaller open area compared to the other rows.

6. The process of claim 1, wherein the determining of the heating requirements of the process stream comprises:

measuring a temperature of the process stream downstream of the DSI heater;

comparing the measured temperature with a target temperature; and determining a corresponding increase or decrease in steam injection via the DSI heater to achieve the target temperature; and wherein the controlling of the piston plug within the tubular body of the diffuser comprises:

closing a number of rows of outlets in response to a determined decrease in steam injection to achieve the target temperature by displacing the piston plug in a single step to the corresponding position; and opening a number of rows of outlets in response to a determined increase in steam injection to achieve the target temperature by displacing the piston plug in a single step to the corresponding position.

7. The process of claim 1, wherein multiple DSI heaters are provided in at least two parallel heating trains, each train comprising at least two of the DSI heaters, and wherein adjacent DSI heaters are spaced apart by at least 40 pipe diameters.

8. A direct steam injection (DSI) heater for heating a process stream in a bitumen froth treatment operation, the DSI heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam, the outlets being arranged in multiple side-by-side rows on respective planes that are each perpendicular to a longitudinal axis of the tubular body;

a piston plug mounted within the tubular body of the diffuser and being configured to axially move between different positions within the tubular body, the piston plug comprising a plug body and at least a first annular seal and a second annular seal positioned at opposed ends thereof, the piston plug being controllable within the tubular body of the diffuser to provide an open area of the outlets through which steam is injected into the process stream, by axially displacing the piston plug within the tubular body between different axial positions in a stepwise fashion to selectively cover or uncover corresponding rows of outlets to provide the open area for steam injection, such that when one or more rows of outlets are completely covered:

the first annular seal is located in between and spaced apart from adjacent rows of outlets, and abuts against inner surfaces of the tubular body, and the second annular seal abuts against inner surfaces of the tubular body to inhibit steam from passing beyond the second annular seal toward the covered outlets.

9. The DSI heater of claim 8, wherein the outlets are sized and configured for injecting the steam at sonic flow conditions.

10. The DSI heater of claim 8, wherein the piston plug is configured to axially move in response to measured heating requirements of the process stream.

11. The DSI heater of claim 8, wherein the piston plug is configured to progressively cover the rows of outlets upon distal displacement within the tubular body, and wherein the plug body is tubular allowing passage of steam therethrough.

12. The DSI heater of claim 8, wherein the plug body comprises a distal groove configured to receive the first annular seal therein, and a proximal groove configured to receive the second annular seal therein, and wherein the first and second annular seals are spaced apart from each other by a separation distance that is greater than a length of the perforated injection section.

13. The DSI heater of claim 8, wherein the first annular seal has a width of about 0.125 inch to about 0.25 inch, and wherein the rows of outlets are arranged such that adjacent rows are spaced apart from each other by about 0.59 inch to about 0.75 inch.

14. The DSI heater of claim 8, wherein the rows of outlets are arranged such that adjacent rows are spaced apart from each other by a spacing distance between about twice to three times greater than a diameter of the outlets.

15. The DSI heater of claim 8, wherein the rows of outlets comprise at least one distal end row at a distal end of the tubular body, and each distal end row has a smaller open area compared to the other rows.

16. The DSI heater of claim 15, wherein the distal end row has fewer outlets compared to the other rows.

17. The DSI heater of claim 16, wherein the outlets of the distal end row are each of the same size as the outlets in the other rows.

18. The DSI heater of claim 15, wherein the distal end row has smaller outlets compared to the other rows.

19. The DSI heater of claim 15, wherein the outlets of the rows proximal with respect to the distal end row are aligned longitudinally along an axis of the tubular body to form corresponding columns of outlets, and wherein the outlets of the distal end row are offset with respect to the columns of outlets along a circumference of the tubular body.

20. The DSI heater of claim 8, wherein the piston plug further comprises a connection mechanism for connecting the plug body to a displacement stem, and the second annular seal is located on the plug body distally with respect to the connection mechanism.

21. The DSI heater of claim 8, wherein the first and second annular seals each comprise:

a spring loaded annular core composed of metal; and an outer portion mounted about the annular core and composed of a polymeric material.

22. The DSI heater of claim 8, wherein the first and second annular seals each comprise a metallic ring configured to be openable for installation about the piston plug and closable in an installed position.

23. The DSI heater of claim 8, wherein the first and second annular seals each comprise a solid ring, and the piston plug comprises a central portion and two opposed end portions configured to be fixed onto either end of the central portion to thereby define corresponding grooves for receiving the first and second annular seals respectively, wherein the annular seals are mounted prior to fixing the two opposed end portions to the central portion.

24. A process for heating a process stream flowing in a bitumen froth treatment operation, the process comprising:

injecting steam directly into the process stream via a direct steam injection (DSI) heater comprising:

a diffuser extending into the process stream and comprising a tubular body having a proximal portion in fluid communication with a steam source and configured to receive steam therefrom, and a distal portion comprising a perforated injection section having outlets in fluid communication with the process stream for injecting the steam, the outlets being arranged in multiple side-by-side rows on respective planes that are each perpendicular to a longitudinal axis of the tubular body; and a piston plug mounted within the tubular body of the diffuser and being configured to axially move between different positions within the tubular body, the piston plug comprising a plug body and at least a first annular seal and a second annular seal positioned adjacent opposed ends of the plug body;

axially displacing the piston plug within the tubular body between different axial positions to selectively cover or uncover corresponding rows of outlets to provide an open area for steam injection, such that when one or more rows of outlets are completely covered:

the first annular seal is located in between and spaced apart from adjacent rows of outlets, and abuts against inner surfaces of the tubular body; and the second annular seal abuts against inner surfaces of the tubular body to inhibit steam from passing beyond the second annular seal toward the covered outlets.

25. The process of claim 24, wherein the piston plug is configured to progressively cover the rows of outlets upon distal displacement within the tubular body, and wherein the plug body is tubular allowing passage of steam therethrough.

26. The process of claim 25, wherein the plug body comprises a distal groove configured to receive the first annular seal therein and a proximal groove configured to receive the second annular seal therein, and wherein the first and second annular seals are spaced apart from each other by a separation distance that is greater than a length of the perforated injection section.

27. The process of claim 24, wherein the rows of outlets are arranged such that adjacent rows are spaced apart from each other by a spacing distance between about twice to three times greater than a diameter of the outlets.

28. The process of claim 24, wherein the rows of outlets are arranged such that the rows are evenly spaced apart from each other.

29. The process of claim 24, wherein the rows of outlets comprise at least one distal end row at a distal end of the tubular body, and each distal end row has a smaller open area compared to the other rows.

30. The process of claim 24, wherein each distal end row has fewer outlets compared to the other rows, the outlets of each distal end row are each of the same size as the outlets in the other rows, the outlets of the rows proximal with respect to the distal end row are aligned longitudinally along an axis of the tubular body to form corresponding columns of outlets, the outlets of the distal end row are offset with respect to the columns of outlets along a circumference of the tubular body, and the least one distal end row comprises at least two distal end rows of outlets.

31. The process of claim 24, further comprising determining of the heating requirements of the process stream, wherein the determining comprises:

measuring a temperature of the process stream downstream of the DSI heater;

comparing the measured temperature with a target temperature; and determining a corresponding increase or decrease in steam injection via the DSI heater to achieve the target temperature.

32. The process of claim 24, wherein multiple DSI heaters are provided in series for heating the process stream; and the multiple DSI heaters are controlled to provide an overall steam injection.

33. The process of claim 24, wherein multiple DSI heaters are provided in parallel; the multiple DSI heaters are provided in at least two parallel heating trains, each train comprising at least two of the DSI heaters; and the parallel heating trains are operated alternately.

34. The process of claim 24, wherein the process stream comprises a slurry stream, a bitumen froth stream, a hydrocarbon stream, a process water stream, or a tailings stream.

35. The process of claim 24, wherein the bitumen froth treatment operation is a paraffinic froth treatment operation.

36. The process of claim 24, wherein the steam is injected at sonic flow conditions provided by substantially maintaining a constant steam velocity and providing the outlets with size and configuration for sonic flow.

37. The process of claim 24, wherein the steam provided from the steam source to the diffuser has a steam temperature that is between 10° C. and 25° C. superheated, and wherein the steam provided from the steam source to the diffuser has a steam pressure of between 2100 and 2950 kPag.

38. The process of claim 24, wherein when the process stream is a bitumen froth stream the measuring of the temperature of the bitumen froth stream is performed at a location that is at least 20 pipe diameters downstream of an adjacent upstream DSI heater, and wherein when the process stream is a water stream the measuring of the temperature of the water stream is performed at a location that is at least 5 pipe diameters downstream of an adjacent upstream DSI heater.

* * * * *